US006322315B1

(12) United States Patent
Schmidt, V et al.

(10) Patent No.: US 6,322,315 B1
(45) **Date of Patent: *Nov. 27, 2001**

(54) WEB STACKER AND SEPARATOR APPARATUS AND METHOD

(75) Inventors: Charles Louis Schmidt, V, Florence; Jie Ning, Ashland, both of WI (US)

(73) Assignee: C.G. Bretting Manufacturing Company, Inc., Ashland, WI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/411,526

(22) Filed: Oct. 4, 1999

(51) Int. Cl.[7] ..... B65G 57/10

(52) U.S. Cl. ..... 414/789.9; 414/789; 414/790.3; 198/431; 198/802

(58) Field of Search ..... 414/789.9, 789, 414/790, 790.3, 794.6, 793.8, 14; 198/431, 802

(56) References Cited

U.S. PATENT DOCUMENTS

| | | |
|---|---|---|
| Re. 27,765 | 10/1973 | Salomon . |
| 1,586,544 | 6/1926 | White . |
| 1,701,760 | 2/1929 | Paffen . |
| 1,991,411 | 2/1935 | Novick . |

(List continued on next page.)

FOREIGN PATENT DOCUMENTS

| | | |
|---|---|---|
| 219396 | 1/1962 | (AT) . |
| 372031 | 3/1923 | (DE) . |
| 442935 | 4/1927 | (DE) . |
| 719833 | 4/1942 | (DE) . |
| 321873 | 11/1929 | (GB) . |
| 1479299 | 7/1977 | (GB) . |
| 646301 | 2/1966 | (IT) . |
| 116974 | 8/1946 | (SE) . |

OTHER PUBLICATIONS

"Terminology As Applied To Bretting Chain Driven Separator Transfer–T/LY", 3/5/8 . Ser. No. 3650–86 JG4, (13 page brochure).

*Primary Examiner*—Joseph A. Fischetti
(74) *Attorney, Agent, or Firm*—Michael Best & Friedrich LLP

(57) ABSTRACT

A separator and stacker apparatus and method for separating a completed stack of web product from a stack of product being built thereafter. Preferred embodiments of the present invention utilize a stack building carriage having a forked or slotted floor cooperating with a load finger assembly to discharge the completed product stack from the stack building carriage. The load finger assembly preferably has a set of load fingers which mesh with the carriage floor so that when the load finger assembly is actuated, the load fingers pass substantially unobstructed through the stack building carriage. The load finger assembly and the stack building carriage can therefore pass through their motions independently of one another, permitting the stack building carriage to return to a stack building position without waiting for the load finger assembly to retract. Some preferred embodiments of the present invention include finger assemblies adapted for movement alongside the stack building carriage path so that various fingers mounted thereon can be inserted in a range of stack building carriage positions. In addition to added flexibility in count and separation finger operations, the fold over fingers (or a fold over finger and fluid emitters) can perform final fold operations upon product stacks in a range of positions and times rather than only at a set location. Preferred embodiments also include a reject conveyor which, when the stack building carriage and load finger assembly are moved to cleared positions, permits jammed, misfed, or undesirable product to be automatically discharged from the apparatus.

29 Claims, 17 Drawing Sheets

U.S. PATENT DOCUMENTS

| | | | | |
|---|---|---|---|---|
| 1,992,179 | | 2/1935 | Blosser et al. . | |
| 2,011,236 | | 8/1935 | Winter . | |
| 2,109,050 | | 2/1938 | Quick et al. . | |
| 2,631,845 | | 3/1953 | Zuckerman . | |
| 2,787,468 | | 4/1957 | Novick . | |
| 2,929,624 | | 3/1960 | Brooker . | |
| 2,954,881 | | 10/1960 | Hopton et al. . | |
| 3,019,886 | | 2/1962 | Winkler et al. . | |
| 3,044,228 | | 7/1962 | Peterson . | |
| 3,088,604 | | 5/1963 | Nilsson . | |
| 3,163,413 | | 12/1964 | Franke et al. . | |
| 3,207,361 | | 9/1965 | Marcalus . | |
| 3,254,889 | | 6/1966 | Nystrand et al. . | |
| 3,279,664 | * | 10/1966 | Lynch | 414/793.8 |
| 3,279,792 | | 10/1966 | Kostal et al. . | |
| 3,331,183 | | 7/1967 | Gass . | |
| 3,351,215 | | 11/1967 | Kitch . | |
| 3,414,138 | * | 12/1968 | Junemann et al. | 414/793.8 |
| 3,418,895 | | 12/1968 | Palmer . | |
| 3,479,932 | | 11/1969 | Stal et al. . | |
| 3,557,688 | | 1/1971 | Hartbauer et al. . | |
| 3,624,723 | | 11/1971 | Cannon . | |
| 3,643,816 | | 2/1972 | Jacobsen . | |
| 3,656,271 | | 4/1972 | O'Shea et al. . | |
| 3,675,792 | | 7/1972 | Griner et al. . | |
| 3,724,640 | | 4/1973 | Rapparlie . | |
| 3,729,886 | | 5/1973 | Lucas et al. . | |
| 3,752,043 | | 8/1973 | Rapparlie . | |
| 3,766,701 | | 10/1973 | Besserdich et al. . | |
| 3,784,187 | | 1/1974 | Takayanagi et al. . | |
| 3,784,188 | | 1/1974 | De Ligt . | |
| 3,834,689 | | 9/1974 | Lee et al. . | |
| 3,866,905 | | 2/1975 | Trogan et al. . | |
| 3,902,587 | | 9/1975 | Checcucci . | |
| 3,948,504 | | 4/1976 | Woessner et al. . | |
| 3,977,152 | | 8/1976 | Rochla et al. . | |
| 3,995,748 | | 12/1976 | Looney . | |
| 4,070,014 | | 1/1978 | Takahashi . | |
| 4,125,253 | | 11/1978 | Wangermann . | |
| 4,162,733 | | 7/1979 | Wiseman . | |
| 4,181,213 | | 1/1980 | Deutschlander et al. . | |
| 4,183,704 | | 1/1980 | Steinhart . | |
| 4,190,242 | | 2/1980 | Bolza-Schunemann . | |
| 4,229,134 | | 10/1980 | Reist . | |
| 4,269,555 | | 5/1981 | Franks . | |
| 4,279,410 | | 7/1981 | Bolza-Schunemann . | |
| 4,285,621 | | 8/1981 | Spencer . | |
| 4,349,185 | | 9/1982 | Small et al. . | |
| 4,396,336 | | 8/1983 | Malmood . | |
| 4,406,650 | | 9/1983 | Felix . | |
| 4,460,169 | | 7/1984 | Bartesaghi . | |
| 4,474,521 | | 10/1984 | Jaton . | |
| 4,475,730 | | 10/1984 | Trogan . | |
| 4,494,741 | | 1/1985 | Fischer et al. . | |
| 4,508,527 | | 4/1985 | Uno et al. . | |
| 4,613,268 | * | 9/1986 | Capdeboscq et al. | 414/114 |
| 4,650,447 | | 3/1987 | Meschi . | |
| 4,673,382 | | 6/1987 | Buck et al. . | |
| 4,700,939 | | 10/1987 | Hathaway . | |
| 4,717,135 | | 1/1988 | Hathaway . | |
| 4,721,295 | | 1/1988 | Hathaway . | |
| 4,751,807 | | 6/1988 | Couturier . | |
| 4,770,402 | | 9/1988 | Couturier . | |
| 4,824,307 | | 4/1989 | Johnson et al. . | |
| 4,824,426 | | 4/1989 | DuFresne . | |
| 4,874,158 | | 10/1989 | Retzloff . | |
| 4,930,977 | | 6/1990 | Beeman et al. . | |
| 5,040,663 | | 8/1991 | Gould et al. . | |
| 5,074,735 | | 12/1991 | Stock . | |
| 5,088,707 | | 2/1992 | Stemmler . | |
| 5,101,963 | * | 4/1992 | Skarlupka et al. | 198/800 |
| 5,299,793 | | 4/1994 | Couturier . | |
| 5,454,687 | | 10/1995 | Johnson et al. . | |
| 5,460,258 | | 10/1995 | Tisma . | |
| 5,503,518 | | 4/1996 | Scholz . | |
| 5,558,488 | | 9/1996 | Gentry . | |
| 5,730,695 | | 3/1998 | Hauschild et al. . | |
| 5,772,391 | | 6/1998 | Sjogren et al. . | |

* cited by examiner

WEB STACKER AND SEPARATOR APPARATUS AND METHOD

FIELD OF THE INVENTION

The present invention relates to systems and methods which manipulate products of web material, and more particularly, to systems and methods for stacking and separating stacks of web product.

BACKGROUND OF THE INVENTION

In the various web product industries, the demand for faster product output and increased efficiency is continually increasing. Very often, a one or two-second difference in a machine cycle can greatly impact the productivity of a system or device which manipulates, packages, and/or controls the movements of web product. In many web product industries, such a difference can be determinative as to whether or not a system or device is obsolete in light of faster and more efficient alternatives. Industries in which heightened system speed is virtually always in demand include the paper (e.g., for stacking and separating tissue paper, paper toweling, napkins, etc.), foil, textile, synthetic sheeting, and other industries. Although the following discussion focuses upon apparatuses and methods for stacking and separating interfolded web paper product, it should therefore be appreciated that the same holds true for other industries such as those just mentioned and for product which may or may not be interfolded when in stacked form.

A particular design challenge exists in the quick stacking and separation of web product in, for example, interfolding equipment. Stacking and separating processes tend to be a "bottleneck" for upstream and downstream equipment operations. Specifically, conventional stacking and separating systems and devices typically stack a stream of interfolded product upon a stacking surface which is then either lowered, shifted, or opened to separate the stacked product thereon from a new stack of product being built. Examples of stacking surfaces can be found in U.S. Pat. No. 4,874,158 issued to Retzloff, U.S. Pat. Nos. 4,770,402 and 5,299,793 issued to Couturier, and U.S. Pat. Nos. 4,700,939, 4,717,135, and 4,721,295 issued to Hathaway, all of which disclose a stack-building surface which essentially is an-elevator floor movable between an upper stack-building position and a lower stack-discharging position. U.S. Pat. No. 4,229,134 issued to Reist teaches a stack building surface which slides to drop the built stack to a surface below. As another example, U.S. Pat. No. 4,183,704 issued to Steinhart and U.S. Pat. No. 5,730,695 issued to Hauschild et al. disclose a stack-building surface which is actually a set of fork prongs or rods extending beneath and supporting the stack as it is being built.

The process of separating a completed stack from a stack which is to be built presents a speed problem for conventional systems in that time is required to pull, drop, or shift the completed stack to downstream processes. Typically, the elements and/or assemblies necessary to perform these tasks must rapidly move between a number of positions during stacking and separation operations. Nevertheless, every such movement consumes valuable time and limits system speed. One example of wasted time evident in prior art systems is the manner in which elevator-style stack building surfaces move. Conventional systems are designed so that once the stack building surface is lowered to its stack discharging position, one or more elements must complete stack discharging operations before the stack building surface can return to its elevated stack building position. The time necessary for these operations represents an inefficiency which limits the maximum operating speed of the system.

Another problem affecting the speed of conventional stacking and separating systems arises when the systems experience a jam or misfeed. In order to control the manner in which web product is stacked upon a stacking surface, it is commonly necessary to at least partly enclose the stack building surface with rails, guides, walls, or other means. Unfortunately however, this enclosed configuration leads to significant problems during and after a misfeed or jam within the enclosed area (i.e., over the stack building surface) because the area can be very difficult to clear out. Jams and misfeeds in conventional systems are therefore very time-consuming and costly.

Yet another problem experienced in conventional stacking and separating systems is not as directly related to system speed as the problems discussed above, but nevertheless significantly impacts system operations in a negative manner. Consumer demand for stacked web product having a final fold (located at the top of the completed stack, such as for a stack of packaged tissues) creates a demand for elements and assemblies which can form a final fold on the stack during the stacking and separating process. An example of such a system is described and illustrated in the Retzloff patent mentioned above. In the Retzloff patent, mentioned above (U.S. Pat. No. 4,874,158) a pair of fold fingers are mounted in a set vertical position with respect to the stack of product being built. The building stack is continually lowered as it is built, until the bottom of the stack reaches a predetermined level at which are mounted the pair of fold over fingers flanking the bottom of the stack. At a controlled time, the fold over fingers slide toward and under the stack to create a final fold in the last sheet of web product. However, the fact that the fingers are mounted in one vertical position requires this folding operation to be performed at a specific time in the stack-building operation. In some cases, the folding operation therefore limits the entire stacking and separating process, and can result in system delays.

In light of the problems of prior art systems described above, a need exists for a system and method for stacking and separating stacks of web product which can separate a completed stack from a building stack and transport the completed stack to downstream operations faster than conventional systems, which can be cleared of jams and misfeeds quickly and with minimal downtime, and which can perform final folding operations in a more flexible manner to permit faster system operations. Each preferred embodiment of the present invention achieves one or more of these results.

SUMMARY OF THE INVENTION

The present invention is an apparatus and method for separating stacks of web material in a web stacking system. To accomplish this task in a faster and more efficient manner than prior art devices and systems, the invention utilizes a stack building carriage that is able to move independently of its unloading mechanism, most preferably through the use of a slotted or forked floor. The stack building carriage is mounted for movement between a stack building position in which a stack of product is built or transferred and a stack discharging position in which the stack of product is removed from the stack building carriage. The present invention also includes an unloading mechanism which can take the form of a load finger assembly which is adapted for movement through a discharge path. This discharge path passes across or beside the stack building carriage (depending upon system orientation). When the stack building carriage is located in its stack discharging position, movement of the load finger assembly through its discharge path pushes stacked product off of the stack building carriage. Preferably, the load finger assembly is provided with a number of load fingers which pass through the slotted or forked stack building carriage floor. Therefore, as the stack building carriage is moved to its stack discharging position and as the load finger assembly is moved to clear the stack from the stack building carriage, the fingers of the load finger assembly move through the slotted or forked stack building carriage floor. This permits the stack building carriage to move independently of the load finger assembly, and ensures that the two move with substantially no interference in their operations. The advantage of such a design is that after the load finger assembly has moved across the stack building carriage to clear the same, the stack building carriage can quickly return to its stack building position without waiting for the load finger assembly to return to its original position. In stacking and separating systems where a matter of a fraction of a second significantly affects product output, the time saved represents a significant advantage over conventional systems.

One highly preferred embodiment of the present invention utilizes a pair of finger assemblies flanking the path taken by the stack building carriage between the stack building position and the stack discharging position. Preferably, the finger assemblies are mounted for movement along and can be positioned in a range of locations beside the stack building carriage path. Each finger assembly preferably has a count finger, a separation finger, and a fold over element controlled by a system controller. The count fingers and separation fingers can be controlled to be inserted in a stream of web product entering the stacking and separating apparatus. In this manner, the count fingers and separation fingers cooperate to separate a completed stack of product from a new stack of product being built thereafter. Because the separation fingers are preferably mounted for movement alongside the stack building carriage path, a set of separation fingers can then be moved along with the stack building carriage away from the other set of separation fingers in order to bring the completed stack of product to the stack discharging position.

After stack discharge by the load finger assembly, the finger assemblies are preferably positioned closely below the new stack being built. Preferably, the fold over element on each finger assembly then is operated by the controller to create a final fold in the new stack of product. The fold over elements can be two fold over fingers (one on each finger assembly) cooperating to create the final fold, or can be a fold over finger and a fluid emitter such as an air jet directed to blow the tail of the new product stack around the fold over finger to create the final fold. Because the fold over elements are each preferably mounted upon the finger assemblies, the fold over elements can be moved to a number of positions along the stack building carriage path so that final fold operations can be performed in a range of desired times or at the same time for a variety of different product types and thicknesses. The various operations of the present invention therefore need not be timed, sped, or slowed to accommodate the final fold operations as is the case for prior art systems in which fold over fingers are fixed to or can only operate in one place alongside the stack building surface path.

The present invention also preferably utilizes a reject conveyor for discharging rejected stacks of product and misfed or jammed product from the system. To perform this discharging operation, the stack building carriage is preferably movable out of its normal path (between the stack building and stack discharging positions), and the load finger assembly is retracted. An unobstructed path is thereby cleared through the system for rejected, misfed, or jammed product to pass through to the reject conveyor. This reject feature prevents undesirable product stacks from proceeding to downstream operations, and saves considerable time compared to prior art systems which typically require stack building areas within the system to be manually cleared in the event of a misfeed or jam.

More information and a better understanding of the present invention can be achieved by reference to the following drawings and detailed description.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF PREFERRED EMBODIMENTS

Figure 1:
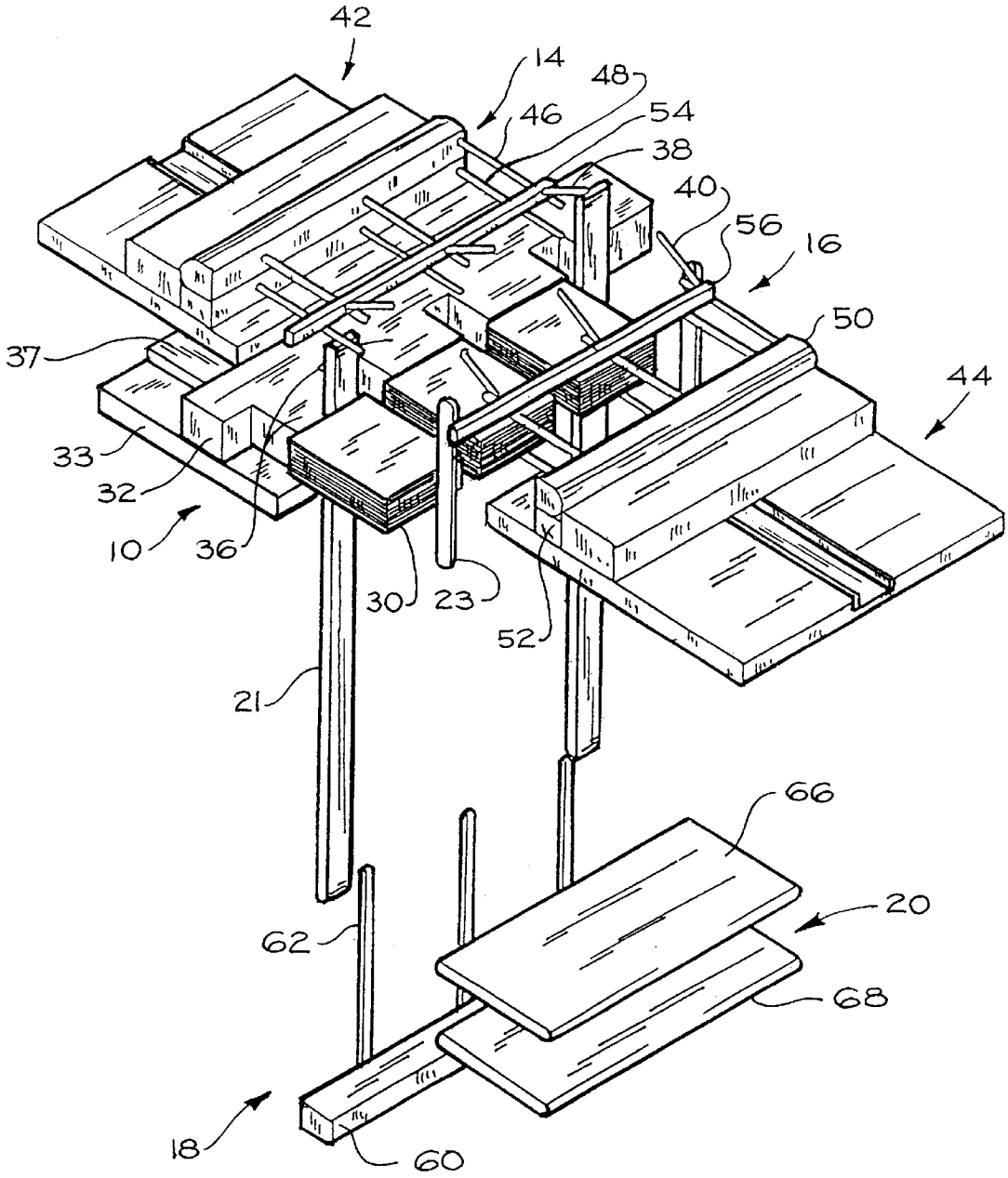
FIG. 1 is a perspective view of the stacking and separating apparatus according to a preferred embodiment of the present invention.
Figure 2:
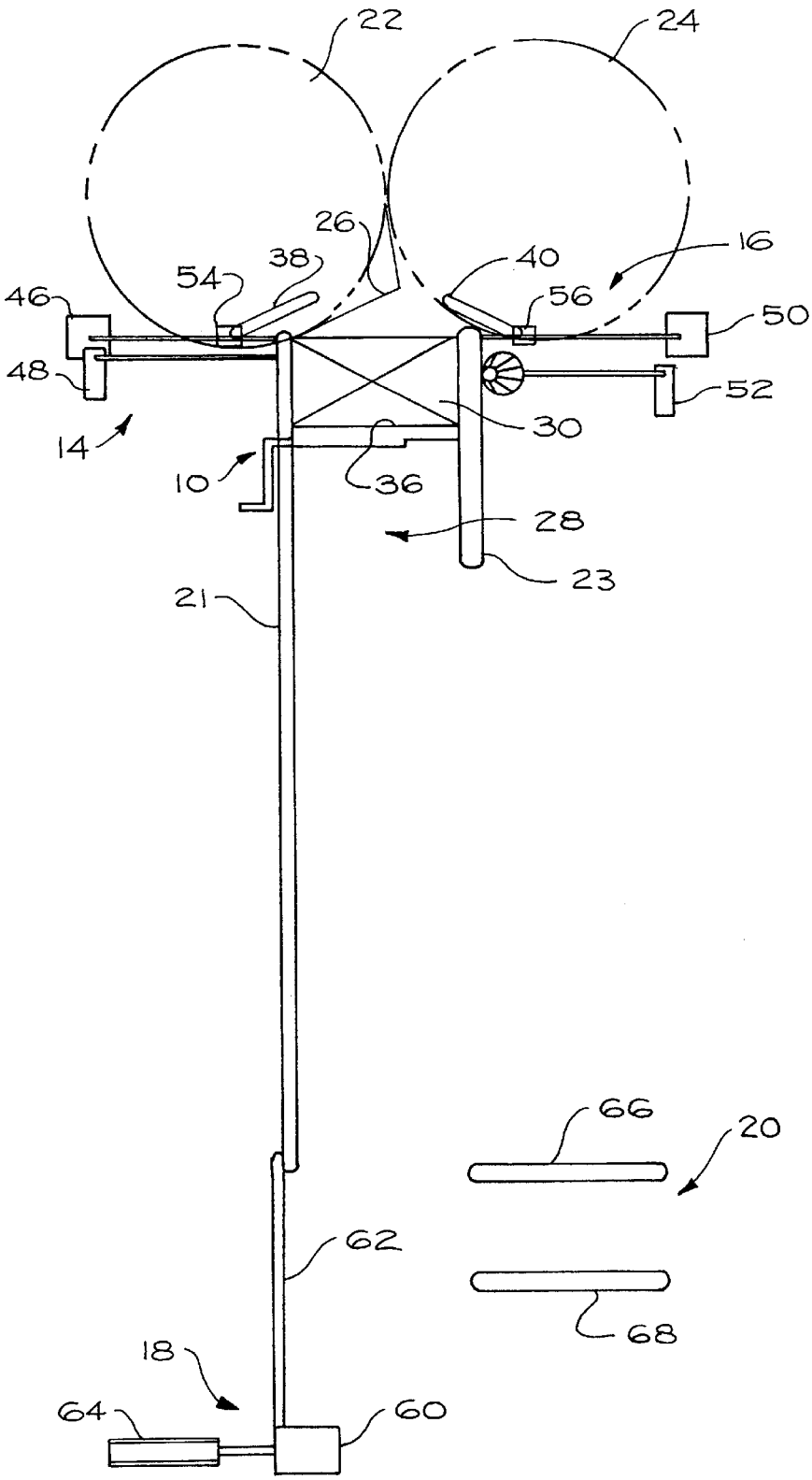
FIGS. 2–13 are elevational views of the stacking and separating apparatus shown in FIG. 1 in twelve consecutive stages of operation.

Referring first to FIGS. 1 and 2, the preferred embodiment of the present invention includes a stack building carriage 10 on a track assembly 12, front and rear finger assemblies 14, 16, a load finger assembly 18, and a conveyor assembly 20 or their equivalents.

With particular reference to FIG. 2, a stream of web product 26 is fed from between a pair of conventional folding rolls 22, 24 and into a stack building area 28. The particular manner in which the web product is passed between the folding rolls 22, 24 and is stacked on the stack building surface of the stack building carriage 10 is well known in the art and is not therefore described further herein. The stream of web product 26 is restrained from shifting or blowing out of the stack being built on the stack building carriage 10 by product guides 21, 23 which flank the stack building area 28. The product guides 21, 23 preferably extend from adjacent the folding rolls 22, 24 to at least a position which contains the tallest anticipated product stack to be built upon the stack building carriage 10. More preferably however, the front product guide 21 runs the entire height of the stack building area 28, while the rear product guide 23 terminates somewhat above the stack discharging area 28 at the lower portion of the apparatus (described below).

The stream of web product 26 being fed and stacked is described herein as a stream of interfolded napkins or tissue. However, and as mentioned above, it will be appreciated by one having ordinary skill in the art that other types of sheet or film product which is desired to be stacked (whether folded, interfolded, or otherwise) can be processed in a similar manner as described herein. For example, the stream of product being fed and stacked can instead be fabric, other types of paper, plastic or other synthetic material sheeting, various types of metal foil and the like.

As a stack 30 of web product grows taller upon the stack building carriage 10, it is preferable to maintain the top of the stack 30 at a substantially constant height so that the top of the stack 30 maintains a preferred distance from the folding rolls 22, 24. Therefore, the stack building carriage 10 preferably is gradually lowered by a conventional system controller (not shown) while the web product is being stacked. In this configuration, the stack building carriage 10 is preferably mounted for controlled vertical displacement on the track assembly 12, as is discussed in more detail below. An example of such a track assembly is disclosed in the Retzloff and Couturier patents discussed above (U.S. Pat. Nos. 4,874,158, 4,770,402, and 5,299,793), the teachings of which are incorporated herein by reference insofar as they relate to track assemblies, finger assemblies (also discussed in more detail below), and the operations of both. However, other mechanisms and assemblies can instead be used to controllably support the stack building carriage 10 in a range of vertical positions. In short, the track assembly 12 enables the stack building carriage 10 to move in a path through the stack building area 28 from an upper stack building position to a lower stack discharging position. The position of the stack building carriage 10 is controllable in a conventional manner so that the stack building carriage 10 can be precisely positioned in a range of positions along its path.

Figure 1A:
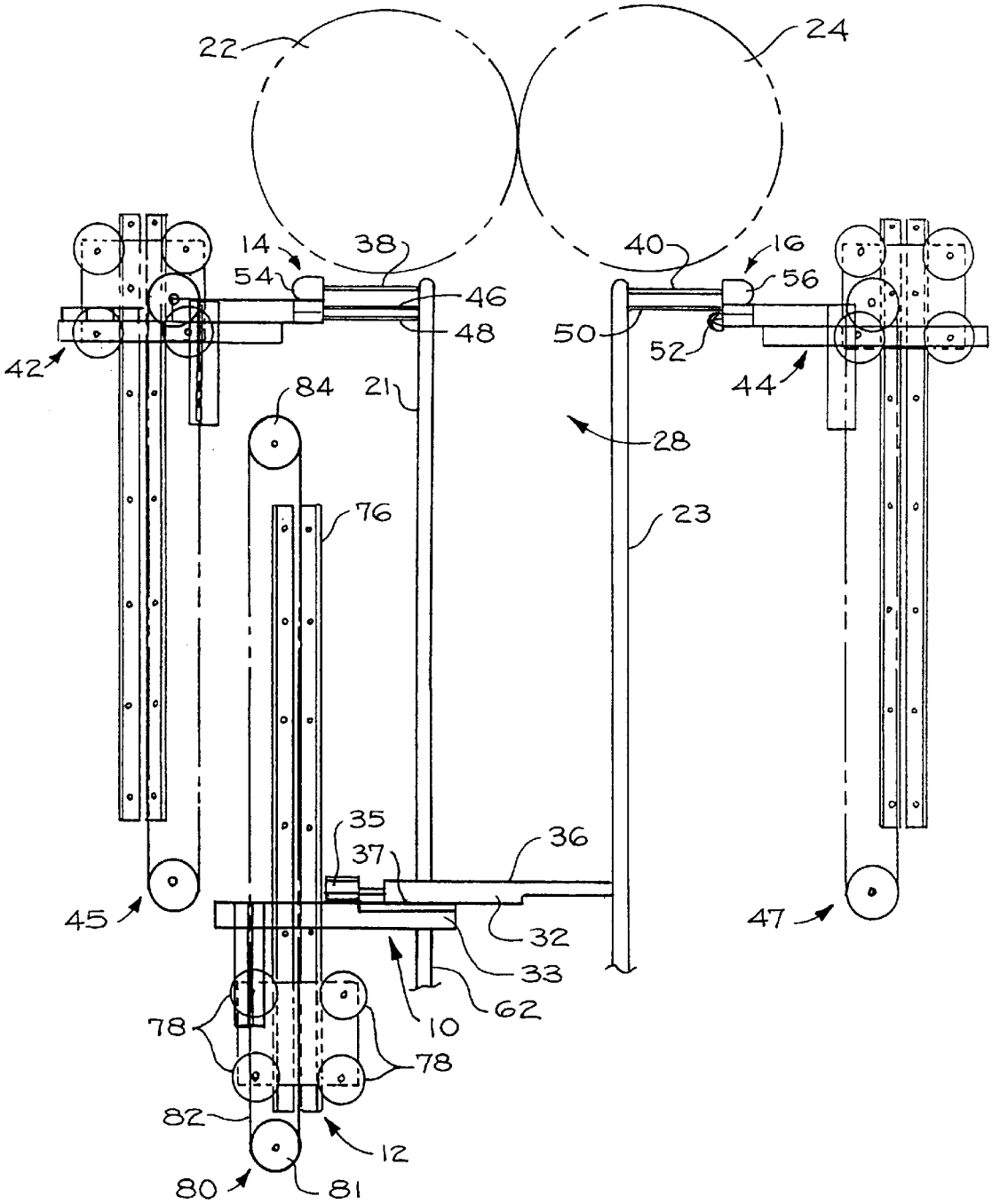
FIG. 1*a* is an elevational view of the stacking and separating apparatus illustrated in FIG. 1, showing the track assemblies for the stack building carriage and the front and rear finger assembly carriages, and with the load finger assembly and the conveyor assembly removed.

With reference to FIG. 1, the stack building carriage 10 is preferably made of two primary portions: a mounting portion 33 and a floor 32 (see in particular FIGS. 1 and 1*a*). The mounting portion 33 is preferably mounted directly to the track assembly 12 beside the stack building area 28 as discussed in more detail below, while the floor 32 is preferably movably connected to the mounting portion 33 and is retractably positioned within the stack building area 28. In highly preferred embodiments of the present invention, the floor 32 of the stack building carriage 10 is generally comb-shaped for purposes which will be discussed in more detail below. The floor 32 is preferably a set of fingers which support the stack 30 being built. Although a unitary stack building carriage 10 can be used in the present invention, the two-portion stack building carriage 10 described above permits the floor 32 of the stack building carriage to retract in stack reject operations discussed in more detail below. Specifically, the floor 32 is preferably connected to the mounting portion 33 via one or more rails, tracks or guides 37 which permit the floor 32 to move relative to the mounting portion 33. To move the floor 32, a conventional actuator 35 mounted to the mounting portion 33 is preferably controlled by the system controller to push or pull the floor along the rails, tracks or guides 37, thereby extending or retracting the floor 32 to or from the stack building area 28.

In the preferred embodiment of the present invention illustrated in the figures, the track assembly 12 has a rail or set of rails 76 mounted beside the stack building area 28 (see FIG. 1*a*). The stack building carriage 10 is preferably mounted for vertical movement along the rails 76 by a set of rail wheels 78 mounted to the stack building carriage 10 in a conventional fashion and riding upon the rails 76. More preferably, the stack building carriage 10 has two or more wheels 78 flanking the rails as shown in the figures so that the stack building carriage 10 is securely mounted for vertical movement beside the stack building carriage 10. Numerous other elements and devices exist for accomplishing the same functions as the rails 76 and wheels 78 in the preferred embodiment of the present invention, including without limitation tracks, guides, slides or runners upon which the stack building carriage 10 can be mounted to glide, roll, slide, or otherwise translate therealong.

Preferably, and with continued reference to FIG. 1*a*, the stack building carriage 10 is movable along the rails 76 by a belt and sprocket assembly 80 running alongside the rails 76 and the stack building area 28. In particular, the track assembly 12 preferably has a belt 82 to which the stack building carriage 10 is either directly or indirectly mounted. The belt 82 preferably runs vertically beside the rails 76 and the stack building area 28, and runs around two or more sprockets, rollers, pins, pulleys, or the like, one or more of which is turned by a conventional power source such as a motor (not shown). Most preferably, the belt 82 runs around two toothed vertically-spaced sprockets 84 which are in driving engagement with teeth on the belt 82. The motor therefore turns the belt 82 to move the stack building carriage 10 alongside the stack building area 28. Preferably, the motor is automatically controlled by a conventional controller to position the stack building carriage in a range of positions in the stack building area 28. However, the motor and the position of the stack building carriage can be controlled manually if desired.

In the preferred embodiment of the present invention, the stack building carriage 10 is clamped to the belt 82 by a member on both sides of the belt having conventional threaded fasteners passed therethrough and through the belt 82. Therefore, the stack building carriage 10 is preferably mounted to the rails 76 for vertical movement alongside the stack building area 28 and is driven along the rails 76 by also being mounted (e.g., clamped) to the belt 82. One having ordinary skill in the art will appreciate that the toothed belt 82 can be replaced by a number of other elements and devices to which the stack building carriage 10 can be attached for moving the stack building carriage 10 alongside the stack building area 28. For example, the stack building carriage 10 can be attached to and be moved by one or more conventional chains, cables, ropes, or any other element capable of transmitting power from wheels, sprockets, pulleys or like elements. The stack building carriage 10 can even be linearly driven by other well-known devices and systems, including without limitation one or more actuators, electromagnetic rails, screw lifting systems, hydraulic cylinders, rods or posts such as those disclosed in the Hathaway patents mentioned above (U.S. Pat. Nos. 4,700,939, 4,717,135, and 4,721,295) and stack flanking support members such as those disclosed in the Hauschild patent also mentioned above (U.S. Pat. No. 5,730,695) which permit elevation and lowering of the stack building carriage. The disclosures of the Hathaway and Hauschild patents are also incorporated by reference herein insofar as they relate to stack building surfaces, their arrangements, movements, and related operations. Of course, the type of driving device employed will at least partly determine the manner in which the stack building carriage 10 is connected thereto. In each case however, the stack building carriage 10 is preferably connected to the driving device in a conventional manner such as by fasteners, welding, or gluing. The alternative driving devices and stack building carriage connection methods just described fall within the spirit and scope of the present invention.

As the stack 30 is being built upon the stack building carriage 10, the number of product elements (i.e., napkins or tissues) is counted in a conventional manner. When the stack 30 reaches a desired product count, the system controller preferably sends a signal to insert two sets of count fingers 38, 40, one set of count fingers on each side of the product stack 30 as shown in the figures. The sets of count fingers 38, 40 are preferably connected to respective front and rear finger assembly carriages 42, 44 on either side of the track assembly 12 (visible in schematic form in FIGS. 1 and 1*a* and removed from FIGS. 2–15 for purposes of clarity). Preferably, the finger assembly carriages 42, 44 serve as platforms upon which various fingers and elements of the finger assemblies 14, 16 (to be discussed below) are mounted for movement relative to the stack building area 28 and the stacks therein. The finger assembly carriages 42, 44 are preferably mounted for substantially vertical movement alongside the stack building area 28 in the same way using identical or substantially similar elements and mechanisms as used in the track assembly 12 for the stack building carriage 10. Specifically, and with continued reference to FIG. 1*a*, the finger assembly carriages 42, 44 are preferably mounted to track assemblies 45, 47 flanking the stack building area 28 and having the same design as the track assembly 12. Like the track assembly 12 of the stack building carriage 10, the rails, belts and motors guiding and driving the finger assembly carriages 42, 44 can be replaced by a number of other elements and systems which perform the same functions as the rails and belts. Such other elements and systems are described above with regard to the track assembly 12 and find equal application in the track assemblies 45, 47 for the finger assembly carriages 42, 44.

Figure 3:
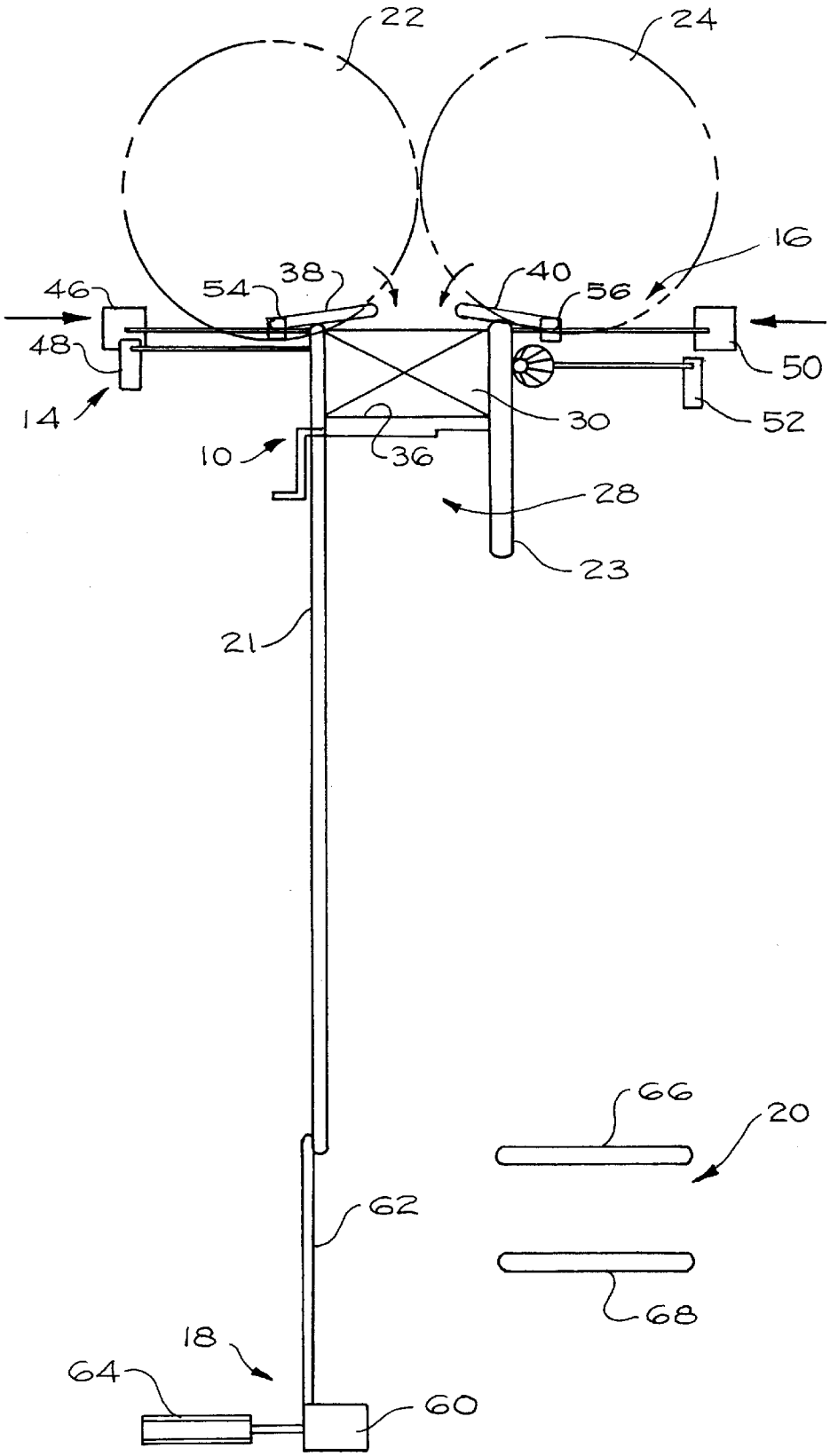

If desired, the count finger sets 38, 40 can instead be fixed in place in the system and mounted only for pivotal movement (i.e., not on finger assembly carriages or finger track assemblies). Such count fingers 38, 40 are also preferably retractable from the stack building area 28 either horizontally or rotatably as is well-known to those skilled in the art. The front finger assembly carriage 42 preferably supports the front finger assembly 14 and permits the front finger assembly 14 to be moved through and supported in a range of vertical positions beside the stack building area 28. Likewise, the rear finger assembly carriage 44 preferably supports the rear finger assembly 16 and permits the rear finger assembly 16 to be moved through and supported in a range of vertical positions beside the stack building area 28. The front finger assembly 14 preferably includes the front count fingers 38, a set of front separation fingers 46, and a set of front fold-over fingers 48, while the rear finger assembly 16 preferably includes the rear count fingers 40, a set of rear separation fingers 50, and a set of horizontally-directed fluid emitters 52 (in one preferred embodiment of the present invention, a set of air jets). The front and rear count fingers 38, 40 are of a conventional type and are preferably pivotably coupled to the respective front and rear finger assembly carriages 42, 44. When actuated by the system controller as described above, the front and rear count fingers 38, 40 pivot about their respective pivots 54, 56 and are thereby inserted into the stream of web product 26 in a manner well-known to those skilled in the art. This stage of the stacking and separation process is illustrated in FIG. 3. By being inserted in this manner, the count fingers 38, 40 leave a gap between successive product elements (e.g., napkins, tissues, etc.). The gaps created by the count fingers 38, 40 permit the front and rear separation fingers 46, 50 to be inserted within the gaps. Specifically, the front and rear separation fingers 46, 50 are preferably mounted to the front and rear finger assembly carriages 42, 44 for horizontal movement into and out of the stack building area 28. Separation fingers 46, 50 which are horizontally slidable or rotatable are also well-known in the art and are not therefore discussed further herein.

Figure 4:
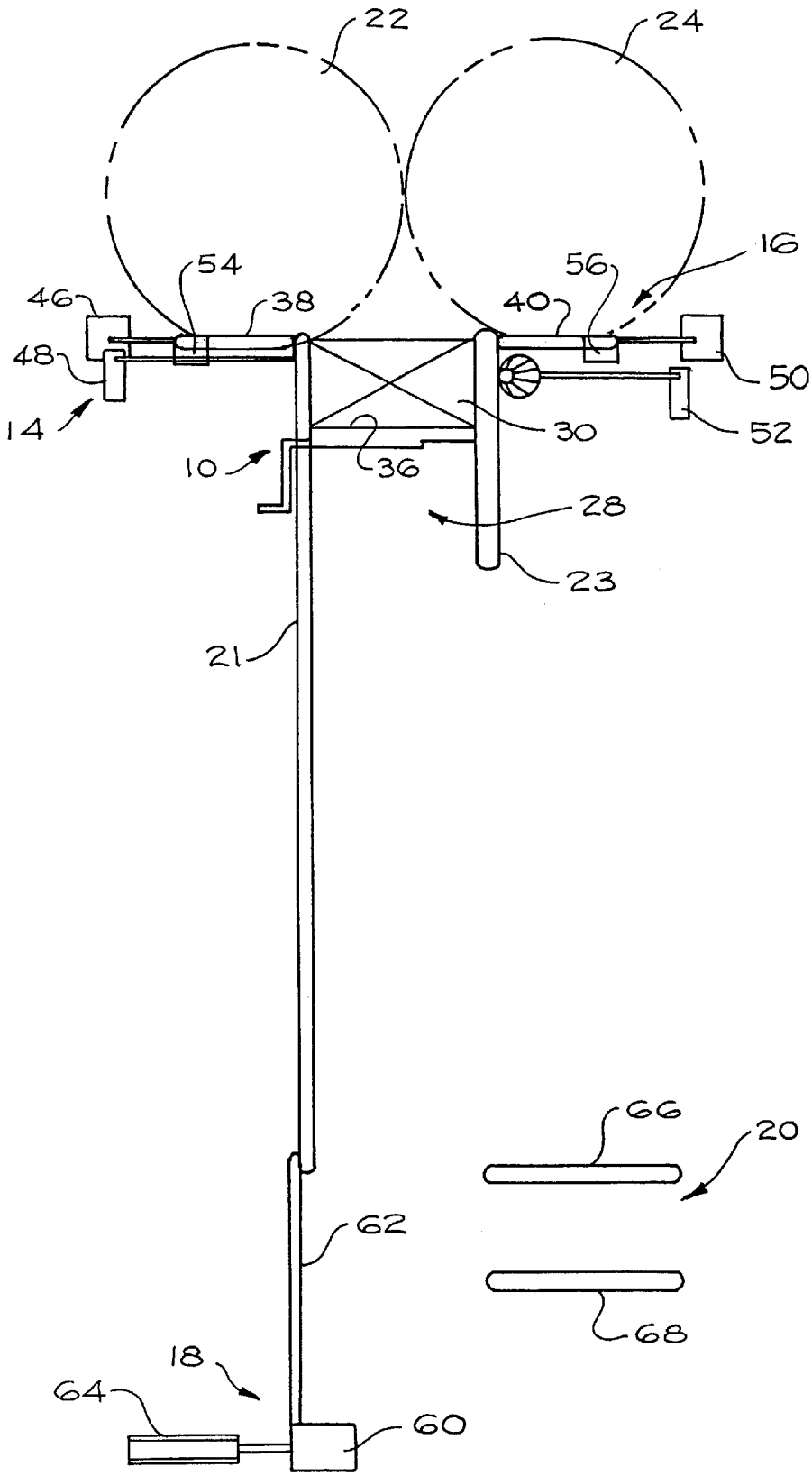

As shown in FIG. 4, once the front and rear count fingers 38, 40 have been pivoted into the product stream 26 leaving the gaps in the stack of product upon the stack building carriage 10, the controller sends a signal to actuate the separation fingers 46, 50 to move into the gaps and to thereby separate a completed stack of product 30 below the separation fingers 46, 50 from a new stack of product 58 being built above the separation fingers 46, 50.

Figure 5:
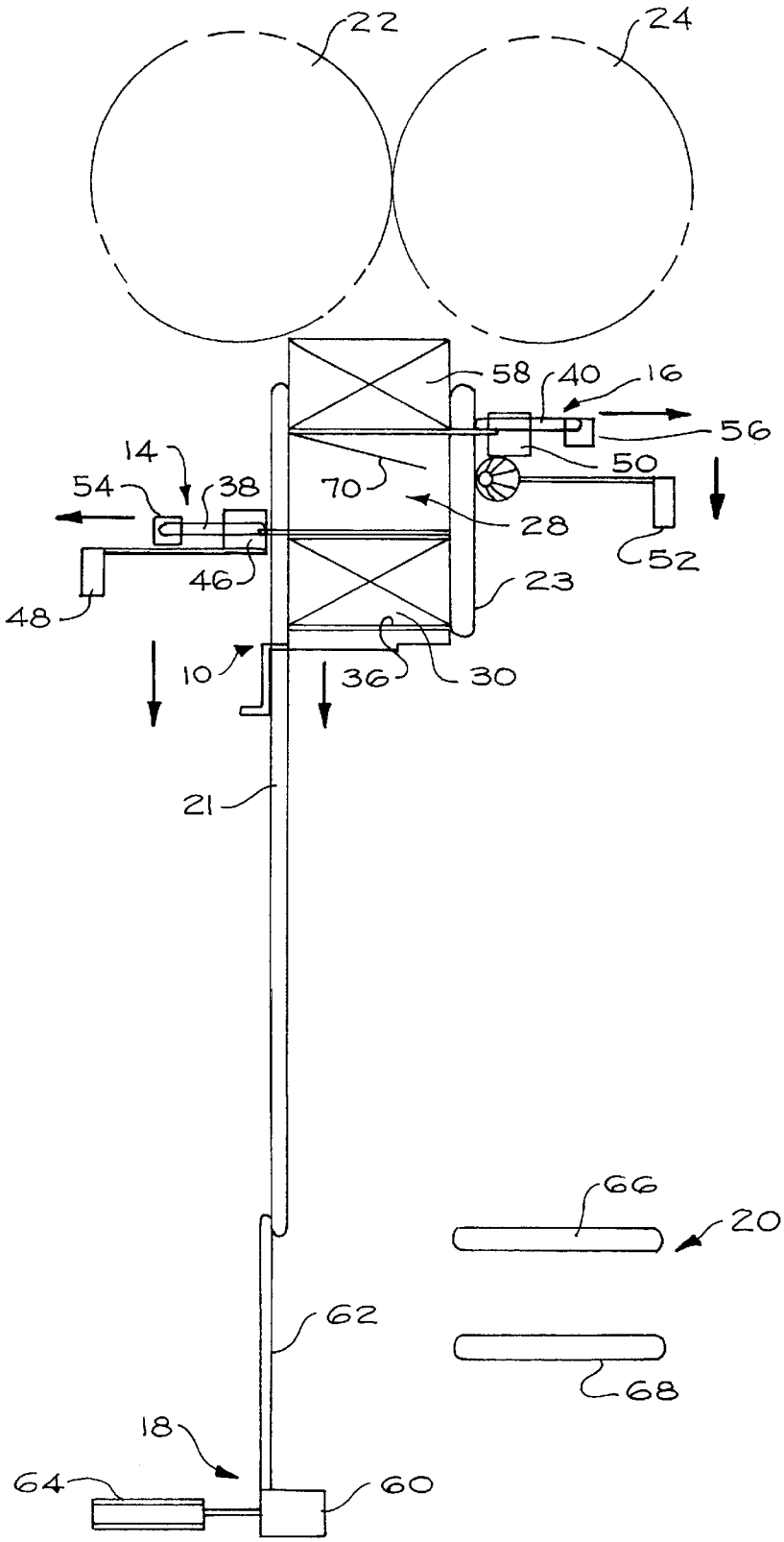

In the next stage of system operation, the controller preferably sends a signal to lower the stack building carriage 10 and the front finger assembly carriage 42 (with the front finger assembly 14) and to retract the front and rear count fingers 38, 40. In doing so, and as shown in FIG. 5, the completed product stack 30 is dropped from beneath the rear separation fingers 50 and the new stack of product 58 being built thereon. It should be noted that although the front and rear count fingers 38, 40 are preferably retracted at this stage, these fingers can be retracted at almost any time after the front and rear separation fingers 46, 50 have been inserted between the product stacks 30, 58 as described above (even until the separation fingers 46, 50 are retracted as described below). Preferably, the front and rear count fingers 38, 40 are not only pivotably mounted as mentioned above but are also mounted for horizontal translation in order to permit the count fingers 38, 40 to retract from the stack building area 28 without disturbing the stacked product. Fingers which are able to both pivot and rotate are well-known to those skilled in the art (see for example the Retzloff and Hauschild patents referenced above (U.S. Pat. Nos. 4,874,158 and 5,730,695, respectively) the teachings of which are incorporated by reference herein insofar as they relate to such finger types), and need not therefore be described in further detail herein.

In order to ensure full control over the completed stack 30 as it is dropped from position beneath the rear separation fingers 50, the front finger assembly carriage 42 is preferably moved along with the stack building carriage 10 as the stack building carriage 10 is lowered. The controller therefore operates the front track assembly 45 in a conventional manner (e.g., turns the belt and sprocket assembly of the front track assembly 45 via a conventional motor) to lower the front finger assembly carriage 42 at substantially the same speed as the track assembly 12 lowers the stack building carriage 10. By doing so, the front separation fingers 46 rest on top of the completed stack 30 to keep the same in place during its downward movement. Preferably, the controller first causes the front finger assembly carriage 42 to lower slightly in order for the front separation fingers 46 to exert a slight compressive pressure upon the completed stack 30 during the subsequent movements of the completed stack 30.

Figure 6:
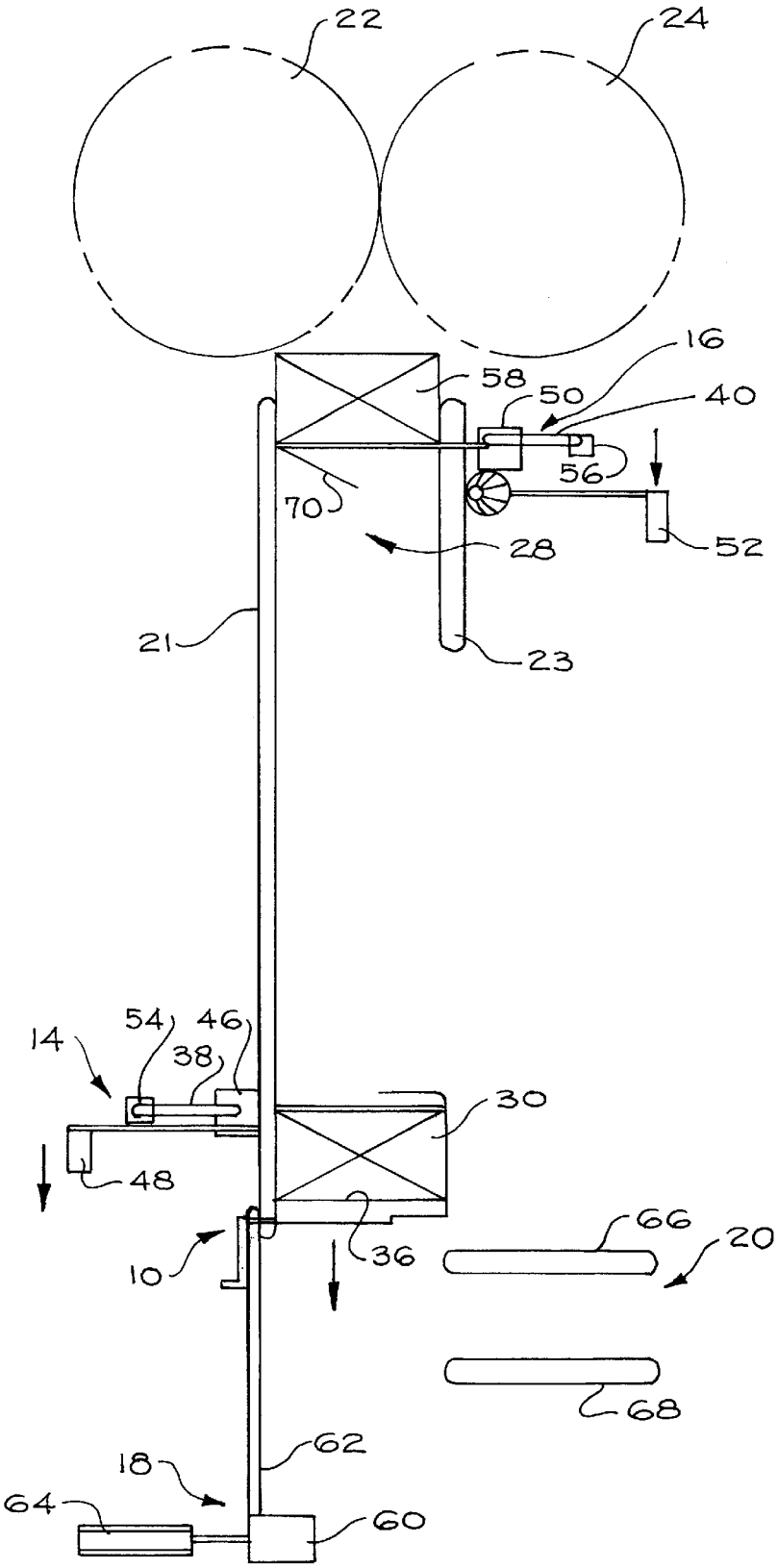

Referring now to FIGS. 6 and 1*a*, the stack building carriage 10 and the front finger assembly carriage 42 are lowered on their respective track assemblies 12, 45 while the new stack 58 is being built upon the rear separation fingers 50. In the position shown in FIG. 6, the stack building carriage 10 is lowered near the load finger assembly 18. As best seen in FIG. 1, the load finger assembly includes a comb-shaped pusher 60 having a number of upwardly-pointed load fingers 62. The comb-shaped pusher 60 is preferably connected to an actuator 64 (see FIGS. 2–15) controlled by the controller and which can push and pull the pusher 60 through a range of horizontal positions defining a travel path for the load finger assembly 18 and the load fingers 62. The actuator 64 and its manner of connection and operation is conventional. It will be appreciated by one having ordinary skill in the art that the pusher 60 can instead be moved through its various positions by a number of commonly-known devices and methods, such as by being mounted on a continuous belt or chain, or by being mounted on one or more rods or rails and pushed or pulled for sliding movement therealong.

As the stack building carriage 10 is lowered to the position shown in FIG. 6, the load fingers 62 of the load finger assembly 18 pass between the fingers 36 of the stack building carriage floor 32. Preferably, there is no significant interference between the load fingers 62 and the fingers 36 of the carriage floor 32 at any point in the motion of the stack building carriage 10 to its lowest stack discharging position illustrated in FIG. 7 or in the later motion of the load fingers 62 through the fingers 36 of the carriage floor 32. In most highly preferred embodiments, this means that the load fingers 62 and the fingers 36 of the carriage floor 32 might come into contact with one another in their respective motions, but do not impede movement. Most preferably, the load fingers 62 and the fingers 36 of the carriage floor 32 slide smoothly through each other with no jarring or binding. When the stack building carriage 10 and the front finger assembly carriage 42 reach the stack discharging position shown in FIG. 7, the controller preferably sends a signal to the actuator 64 to move the pusher 60 toward and through the stack building carriage 10. In this motion, the load fingers 62 pass between the fingers 36 making up the floor 32 of the stack building carriage 10 and push the completed stack 30 from between the stack building carriage 10 and the front separation fingers 46. To assist in a smooth discharge from the stack building carriage 10, the front finger assembly carriage 42 and/or the stack building carriage 10 can be moved to relax the light compressive grip preferably exerted by the front separation fingers 46 upon the completed stack 30.

Of course, a similar function to that of the above-described stack building carriage 10 and load finger assembly 18 is served if the stack building carriage floor 32 or the load finger assembly 18 have slots rather than fingers. In such alternative designs, one of the elements (i.e., either the load finger assembly 18 or the carriage floor 32) has fingers sliding into and between the slots of the companion element (i.e., the carriage slots or the load slots, respectively).

For purposes of practicing the present invention, it should be noted that it is possible for the floor 32 of the stack building carriage 10 to have only one finger upon which the completed stack 30 is built and rests. Likewise, it is possible for the load finger assembly 18 to also have only one load finger 62 which runs alongside one or more of the fingers on the stack building carriage 10 during discharge operations. However, for the sake of stack stability upon the stack building carriage 10 and for smooth discharge operations, it is preferred that both the stack building carriage 10 and the load finger assembly 18 have multiple fingers.

Figure 7:
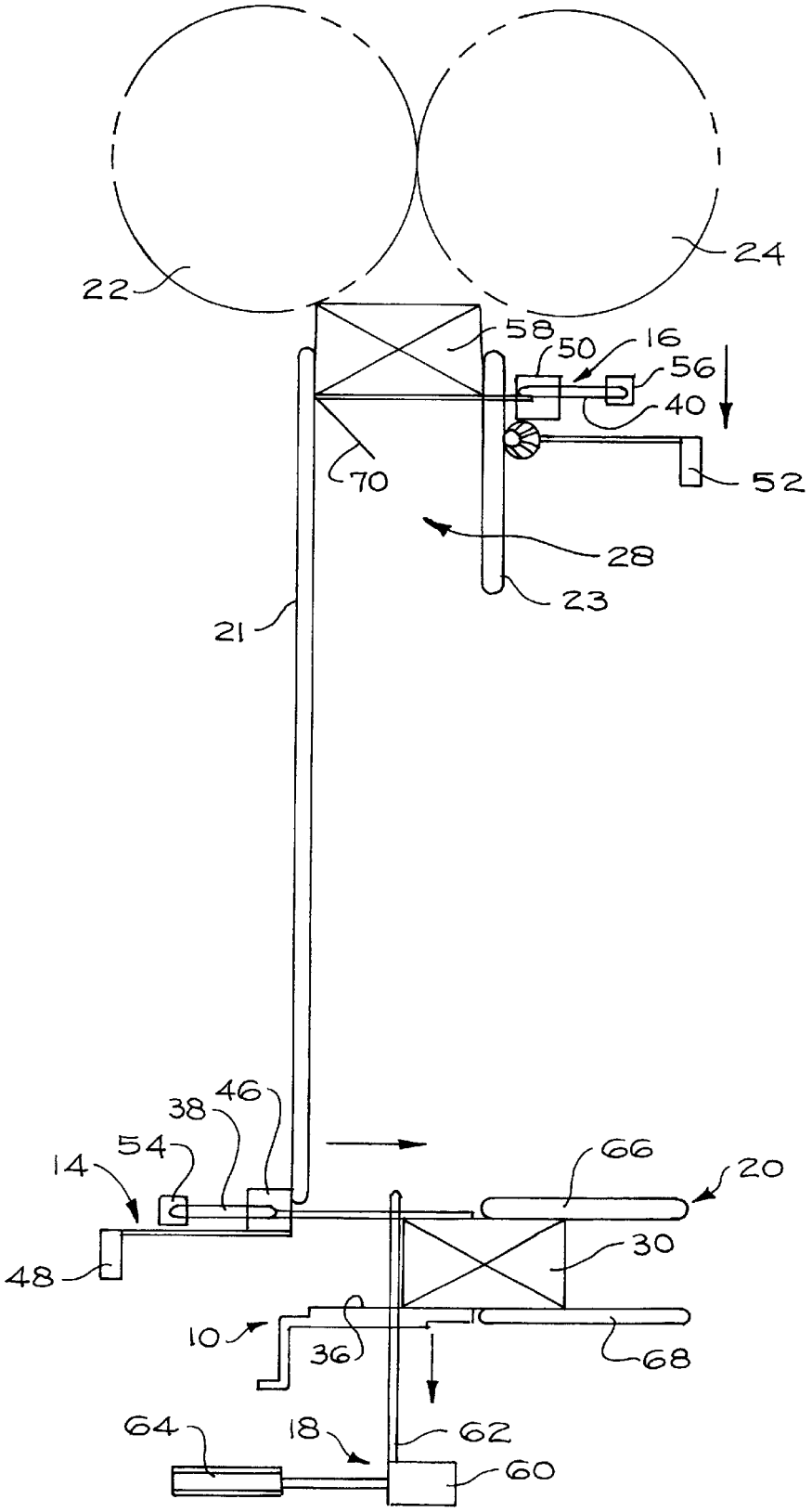

Upon being discharged from the stack building carriage 10, the completed stack 30 is preferably carried off to downstream operations by a conventional product transport device or system. For example, the completed stack 30 is shown in FIG. 7 being moved to a position between upper and lower conveyor belts 66, 68. The conveyor belts 66, 68 are preferably spaced a distance apart so as to gently hold the completed stack 30 therebetween as it is moved from the stacking and separating system. It will be appreciated by one having ordinary skilled in the art that a number of other product transport devices and systems can be used in place of the upper and lower conveyor belts 66, 68 described and illustrated herein.

Figure 8:
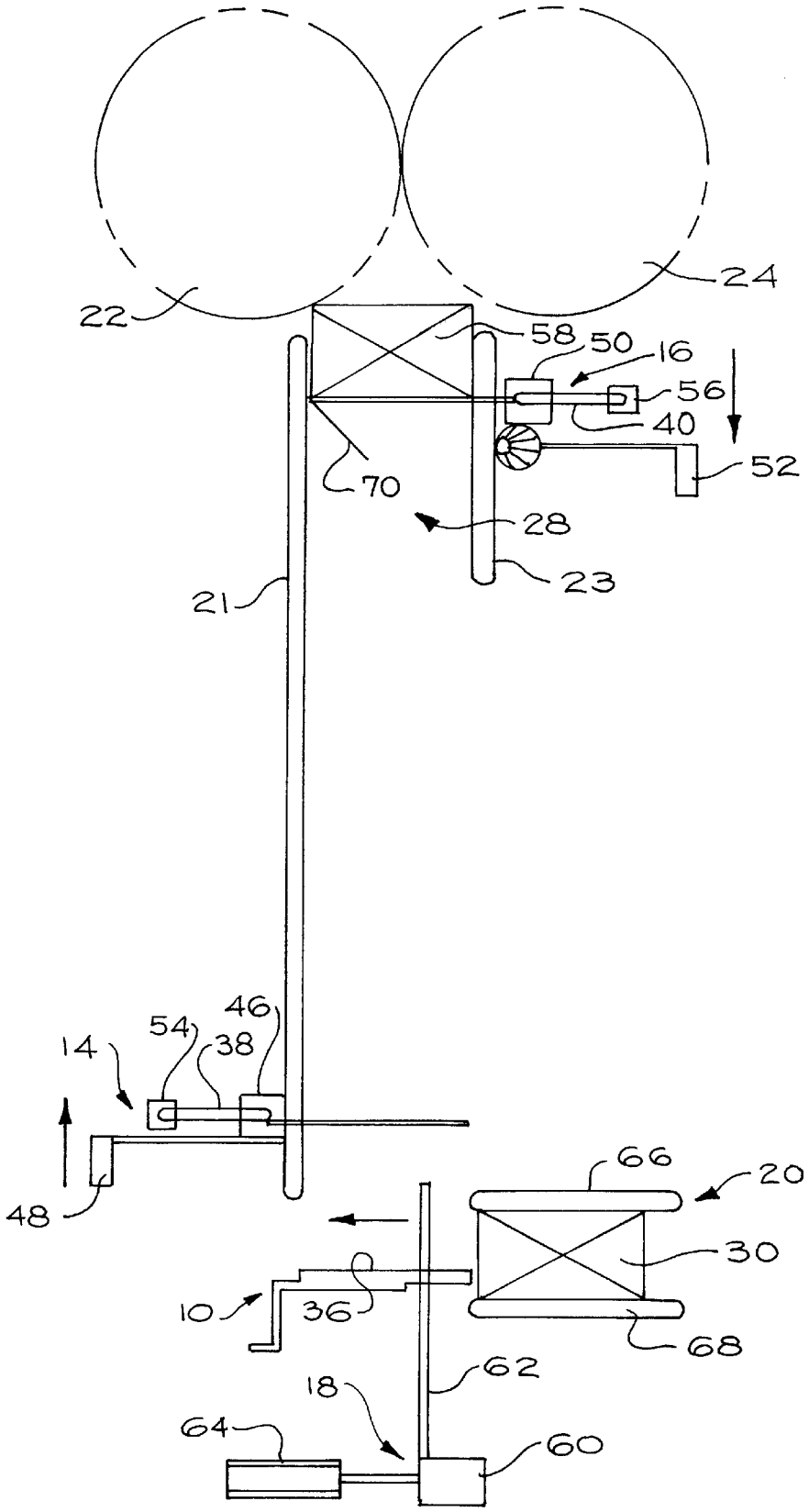

As soon as the completed stack 30 has been discharged from the stack building carriage 10, the stack building carriage 10 is preferably elevated by the track assembly 12 in order to complete stacking operations on the new stack of product 58 being stacked upon the rear separation fingers 50 (see FIG. 8). The arrangement of the load fingers 62 and the fingers 36 of the carriage floor 32 enables the controller to instruct the track assembly 12 to lift the stack building carriage 10 without waiting for the load fingers 62 to retract to their initial position shown in FIGS. 1–6. As noted above, preferably there is substantially no interference between the load fingers 62 and the fingers 36 of the carriage floor 32 during the relative movement of these elements. Therefore, after the completed stack 30 has been discharged to the upper and lower conveyor belts 66, 68, the stack building carriage 10 is free from interference blocking its upward movement. Unlike conventional devices which require substantial movement of the device or element which pushes the completed stack off of the stack building surface prior to permitting the stack building surface to be moved, a significant amount of time is saved in the present system by immediately permitting the stack building carriage 10 to be raised following product discharge.

Figure 9:
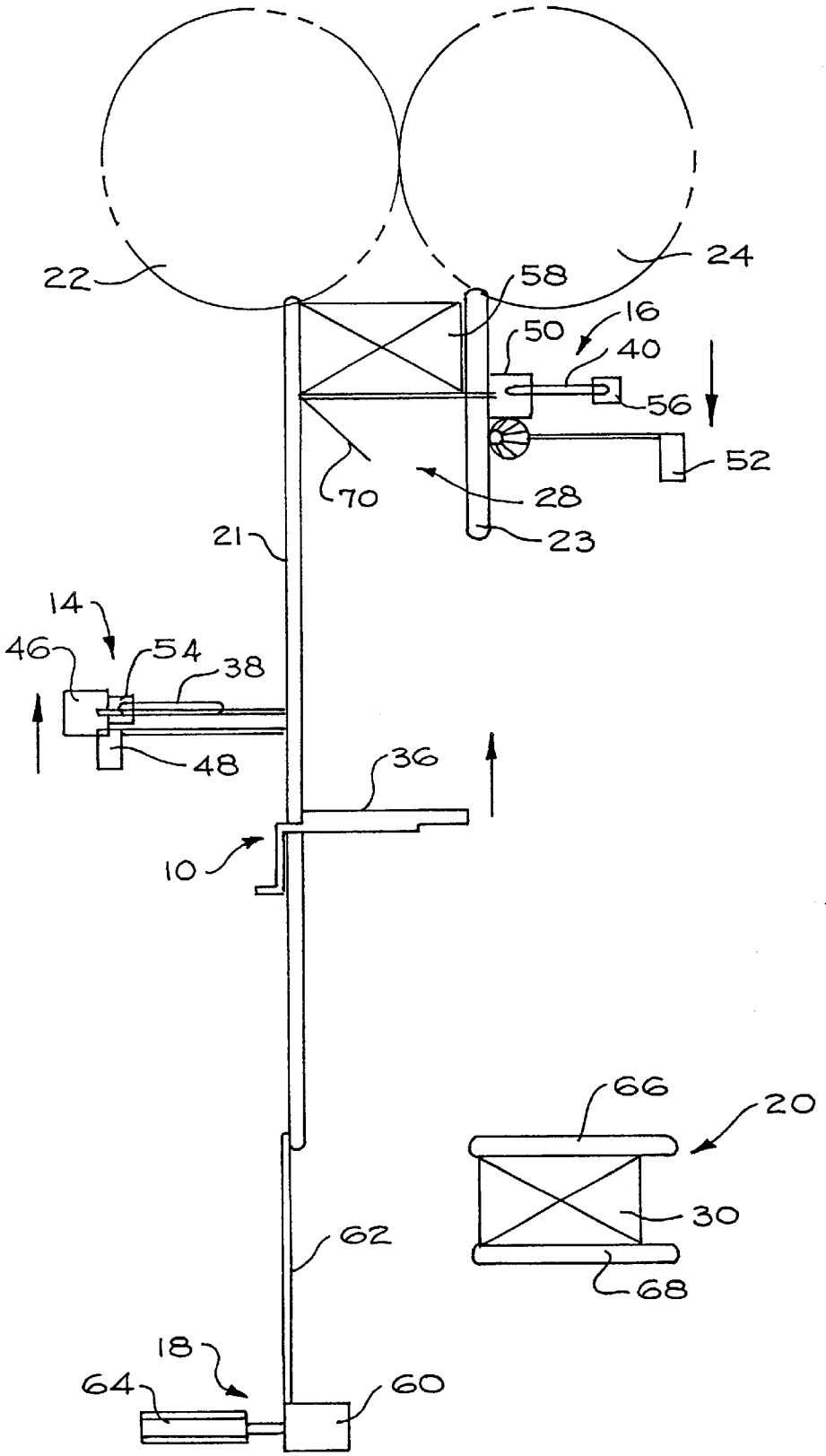

In FIG. 9, it can be seen that the stack building carriage 10 and the front finger assembly carriage 42 are both rapidly elevated by their respective tracks assemblies 12, 45. During this motion, the front separation fingers 46 are preferably retracted from their positions inside the stack building area 28.

Figure 10:
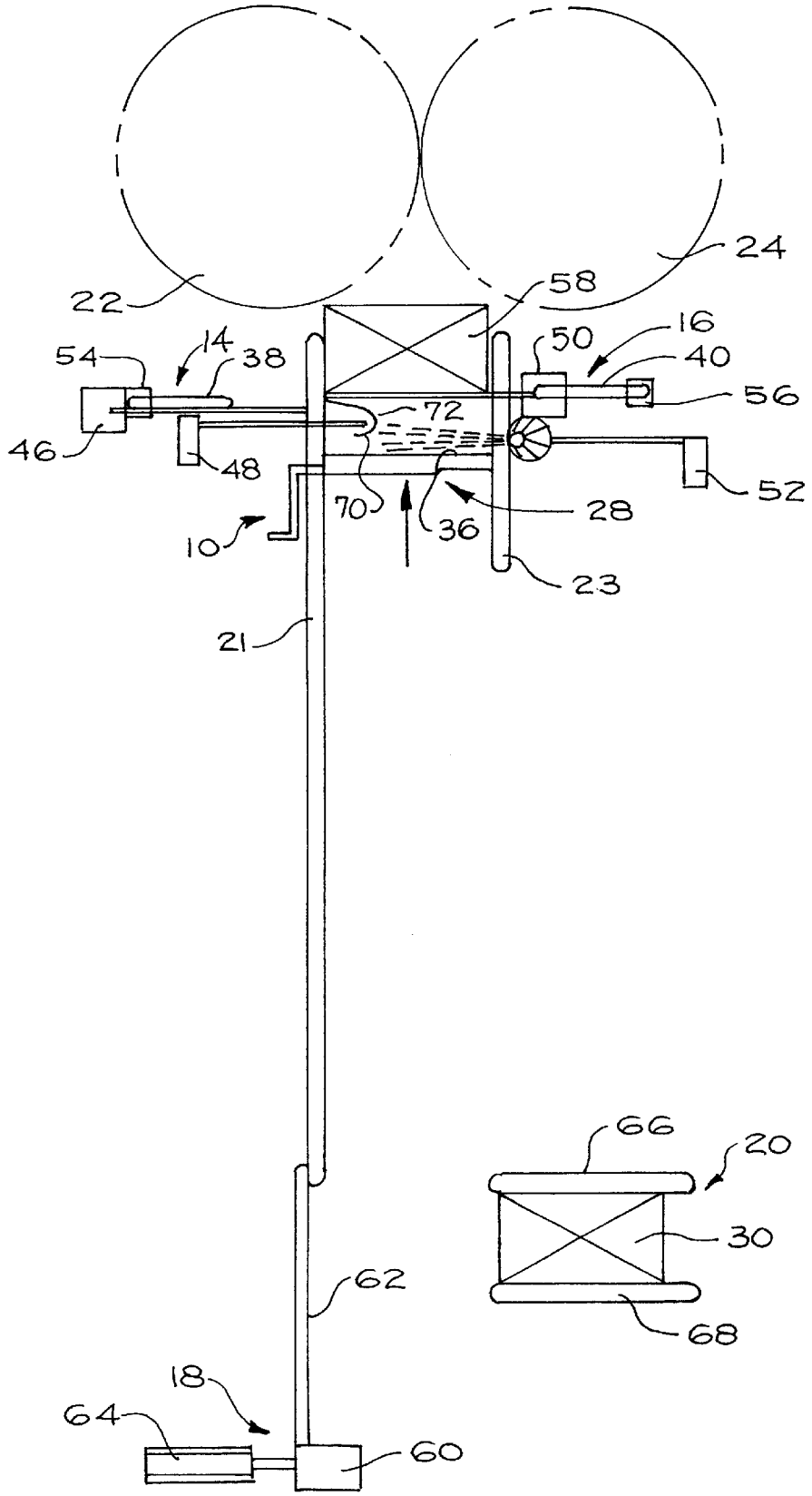

As the new product stack 58 continues to be built upon the rear separation fingers 50, the front finger assembly carriage 42 is elevated to a position just below the rear separation fingers 50 (shown in FIG. 10). The following steps of the system cycle accomplish the result of forming a final fold in the new product stack 58. Of course, it should be noted that these final folding steps need not be performed in the event that the final fold is not desired in the finished stacked product. By eliminating the final folding steps, the front fold over fingers 48 and the series of fluid emitters 52 (having purposes which are described below) can also be eliminated.

The front fold over fingers 48 are preferably a set of fingers which are mounted as described above on the front finger assembly carriage 42 for horizontal movement into and out of the stack building area 28. The front fold over fingers 48 and their manner of actuation are conventional and are well-known to those skilled in the art. An example of such a conventional fold over finger design is disclosed in the Retzloff patent described above (U.S. Pat. No. 4,874,158), the disclosure of which is incorporated herein by reference insofar as it relates to fold over fingers, their arrangement, and their operation. After reaching a position below and near the rear separation fingers 50, the controller preferably sends a signal to actuate the front fold over fingers 48 as shown in FIG. 10. The front fold over fingers 48 extend into the stack building area 28 and push against the tail 70 (of the new product stack 58) dangling from the rear separation fingers 50. Preferably, immediately following the actuation of the front fold over fingers 48, the controller also sends a signal to cause the series of fluid emitters 52 to emit a blast of air toward the tail 70. The motion of the front fold over fingers 48 and the blast of air emitted by the fluid emitters 52 causes the tail 70 of the new product stack 58 to fold around the end of the front fold over fingers 48 as shown in FIG. 10. This creates the desired final fold 72 in the new product stack 58.

An important advantage is realized by the placement of the front fold over fingers 48 and the fluid emitters 52 as described above. Specifically, the front fold over fingers 48 and the fluid emitters 52 are preferably mounted to the front finger assembly carriage 42 and rear finger assembly carriage 44, respectively. Because the front and rear finger assemblies carriages 42, 44 and the finger assemblies 14, 16 thereon are themselves movable and positionable vertically along the front and rear track assemblies 45, 47 (respectively), the front fold over fingers 48 and the fluid emitters 52 can be moved, positioned, and actuated in a range of vertical positions beside the stack building area 28. Prior art systems are inflexible in that the fold over finger assemblies used therein are typically not vertically movable and positionable. This means that in conventional systems, the final folding process as described above must be performed at the same product stack height, regardless of system speed, product thickness, and other factors. As a result, the elements necessary for the final folding process in conventional systems must be ready and able to perform the final folding process when the stack building surface is lowered (during stack building) to a particular level. This either requires elements or assemblies dedicated to the final folding process, the interruption of element or assembly operations to perform the final folding process at the required time, or system slowdown to give enough time for the necessary elements or assemblies to be in their final folding positions.

However, in most highly preferred embodiments of the present invention, the elements necessary to create and hold the final fold (i.e., the front fold over fingers 48, the fluid emitters 52, and the floor 32 of the stack building carriage 10) are all movable and positionable in almost any position alongside the stack building area 28. Therefore, the final folding operation can be performed in a vertical position at a desired time determined by the desired stack height, product thickness, system speed, and other factors. This operation permits the stacking operation to be performed as fast as desired without waiting for the front fold over fingers 48, fluid emitters 52, and stack building carriage 10 to return after product discharge. As a result, the system speed need not be compromised by including a final folding operation in the present invention. In the event that it is not desirable to have the fold over fingers 48 and/or fluid emitters 52 of the present invention movable alongside the stack building area 28 (as with prior art systems), these elements can be fixed in their vertical positions.

Figure 11:
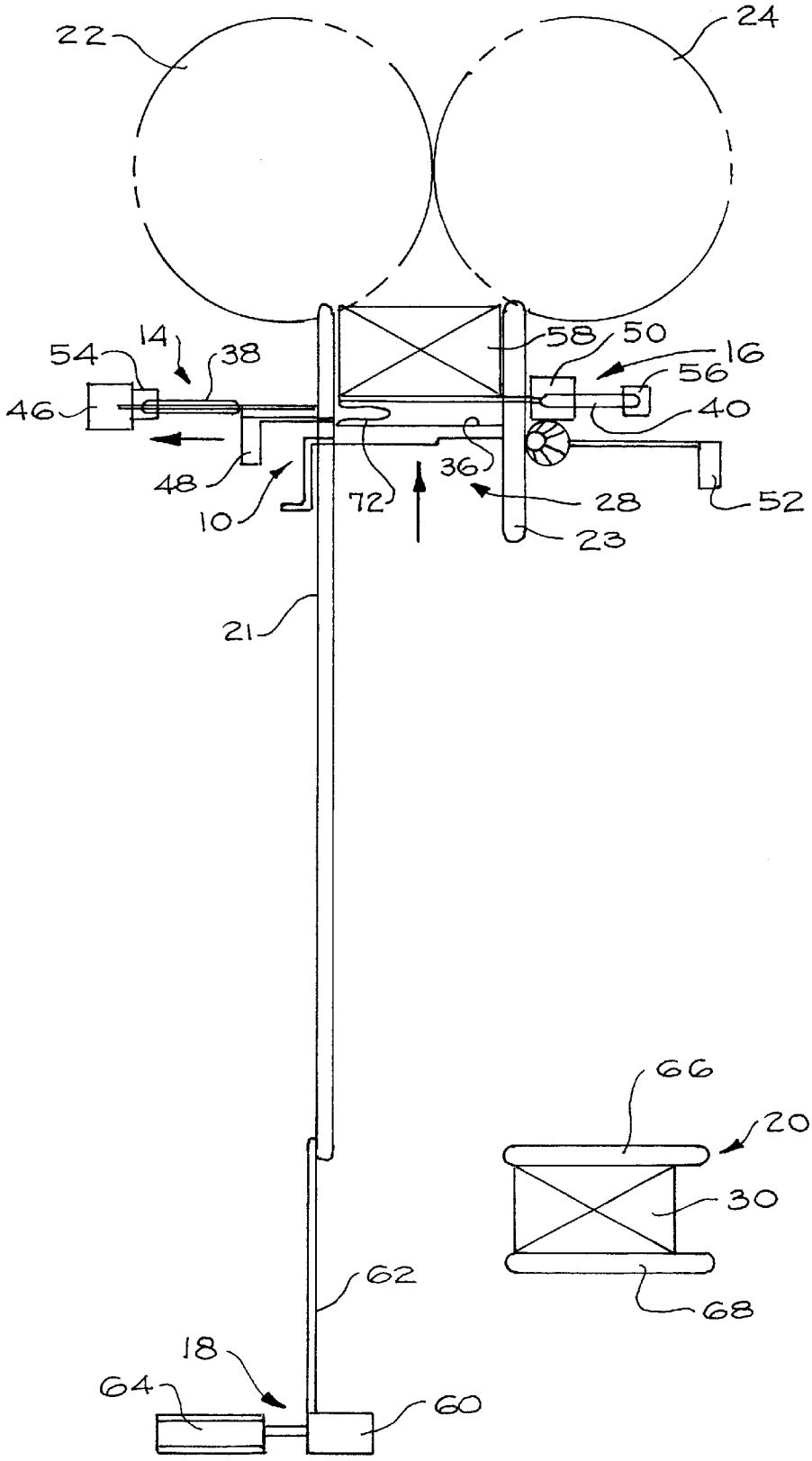

In the next stage of product stacking and separation shown in FIG. 11, the controller preferably sends a signal to the front fold over fingers 48 and the rear separation fingers 50 to retract them both from the new product stack 58 and the stack building area 28. The new product stack 58 then rests upon the stack building carriage 10 preferably until it is discharged in the same manner described above with regard to the completed product stack 30. It should be noted that following the retraction of the front fold over fingers 48 and the rear separation fingers 50, the final fold 72 is preferably held in position against the floor 32 of the stack building carriage 10 under the weight of the new product stack 58.

Figure 12:
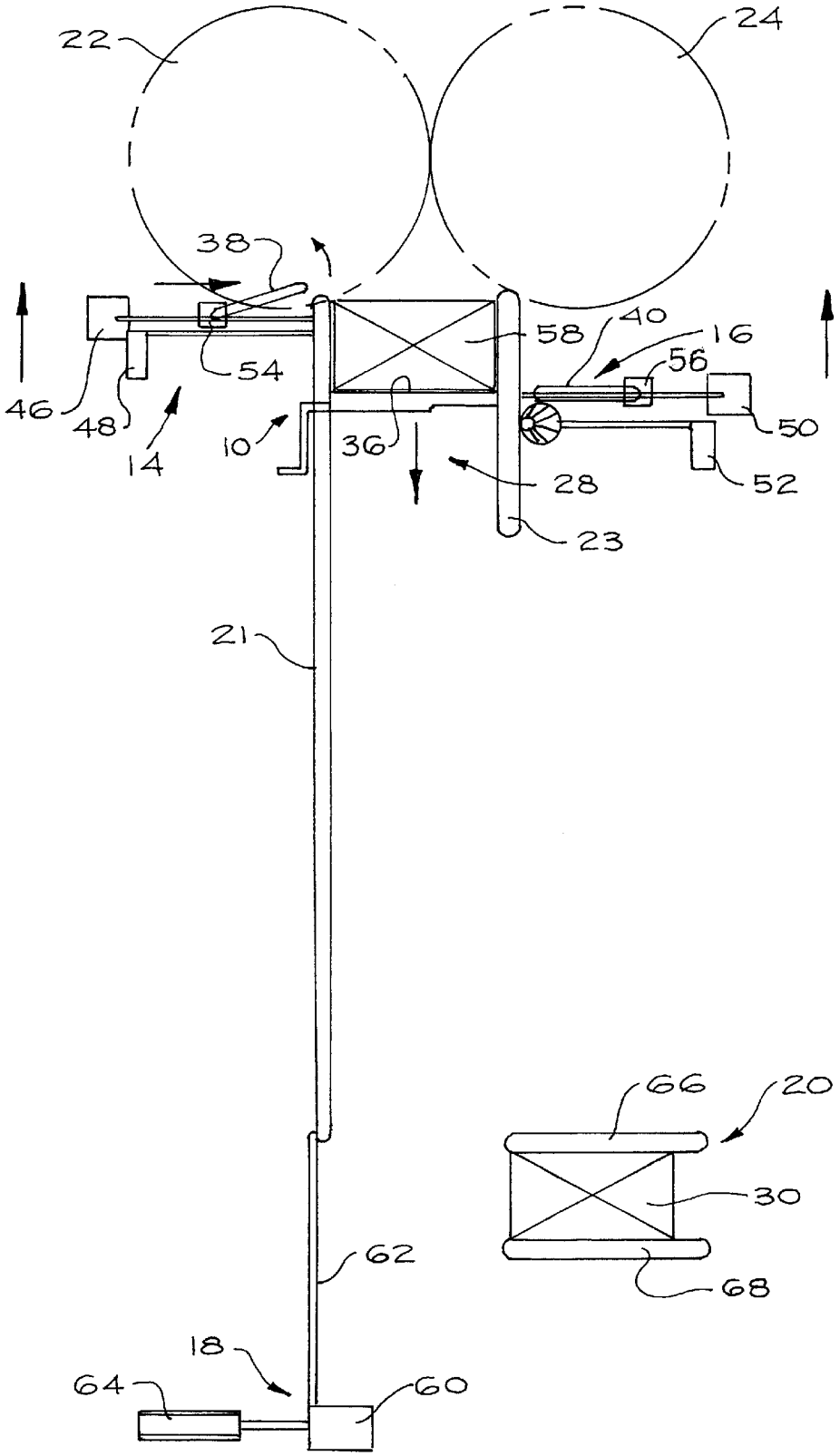
Figure 13:
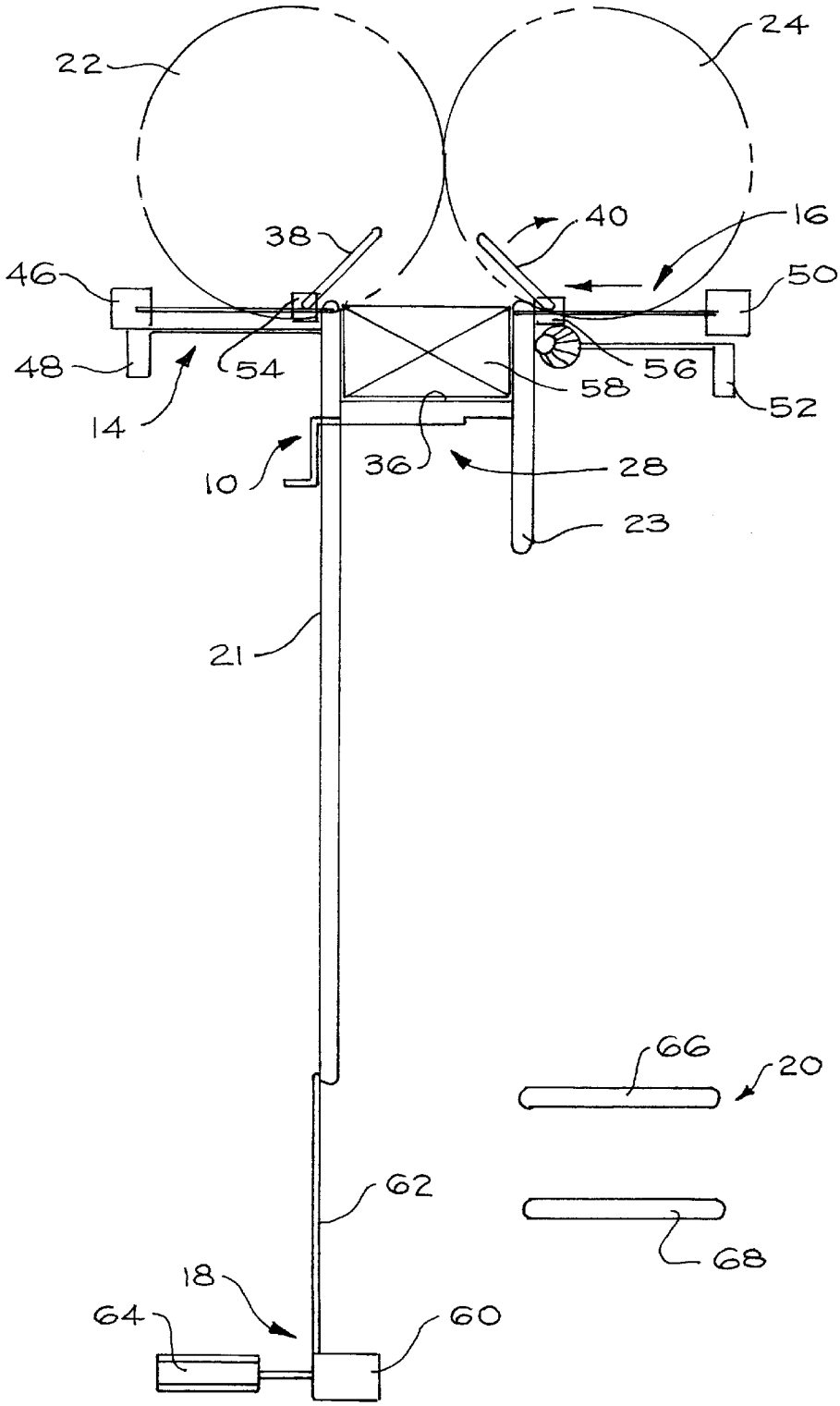

With reference now to FIG. 12, the front and rear finger assembly carriages 42, 44 (with their front and rear count fingers 38, 40, front and rear separation fingers 46, 50, and the front fold over fingers 48 retracted) are next raised to their stack-building positions. The stack building and separating cycle is finally completed when the front and rear count fingers 38, 40 are actuated by the controller to translate toward the stack building area 28 and to pivot to their upward positions as shown in FIG. 13. If desired, and to speed the process of preparing the system for the next stack building and separating cycle, this translation and pivoting motion of the count fingers 38, 40 can occur simultaneously with the movement of the front and rear finger assemblies 14, 16 shown in FIG. 12.

The elements and assemblies in the present invention are now ready to separate the new product stack 58 from the next product stack to be built in the following system cycle. The subsequent steps of the stacking and separating apparatus are preferably the same as those described above and illustrated in FIGS. 2–13, and can be repeated with new stacks of product as many times as desired.

As mentioned above, significant time is wasted in conventional systems when product jams or misfeeds occur. This is generally due to the enclosed designs of the stack building areas employed in prior art systems. The following stages of system operation describe and illustrate how such product jams or misfeeds can be quickly cleared for minimal system downtime. Although the steps described and illustrated are with reference to a misfeed or jam occurring during the stacking of product upon the stack building carriage 10, it will be appreciated by one having ordinary skill in the art that the steps taken in the present invention to clear the system of the jam or misfeed can be taken at virtually any stage of system operation. The various elements and the operation of the present invention as described above with reference to FIGS. 1–13 is substantially the same as those described below and illustrated in FIGS. 14–16.

Figure 14:
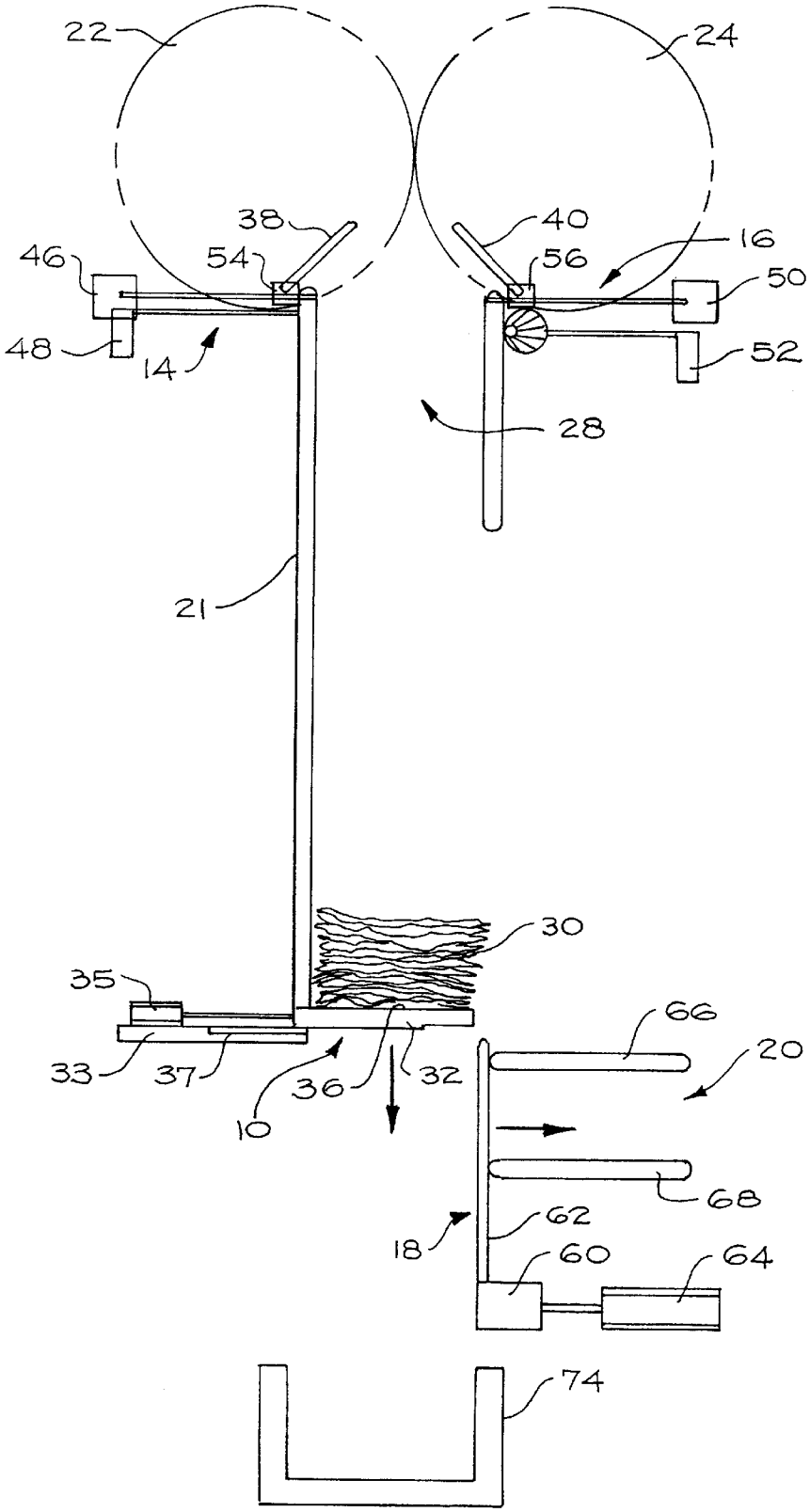
FIGS. 14–16 are elevational views of the stacking and separating apparatus shown in FIGS. 1–13 in three consecutive stages of a reject discharge process.

FIG. 14 shows a product stack 30 which is defective due to a misfeed during stacking. To reject the product stack 30 and clear the system quickly, a reject conveyor 74 is located below the stack building area 28. The reject conveyor 74 is preferably an endless conveyor belt or chain(s) passed around driving sprockets or pulleys (not shown). However, like the upper and lower conveyor belts 66, 68 of the conveyor assembly 20, the reject conveyor 74 can be any number of conventional product transfer devices and systems. The reject conveyor 74 is conventional and is not therefore described in greater detail herein.

Figure 15:
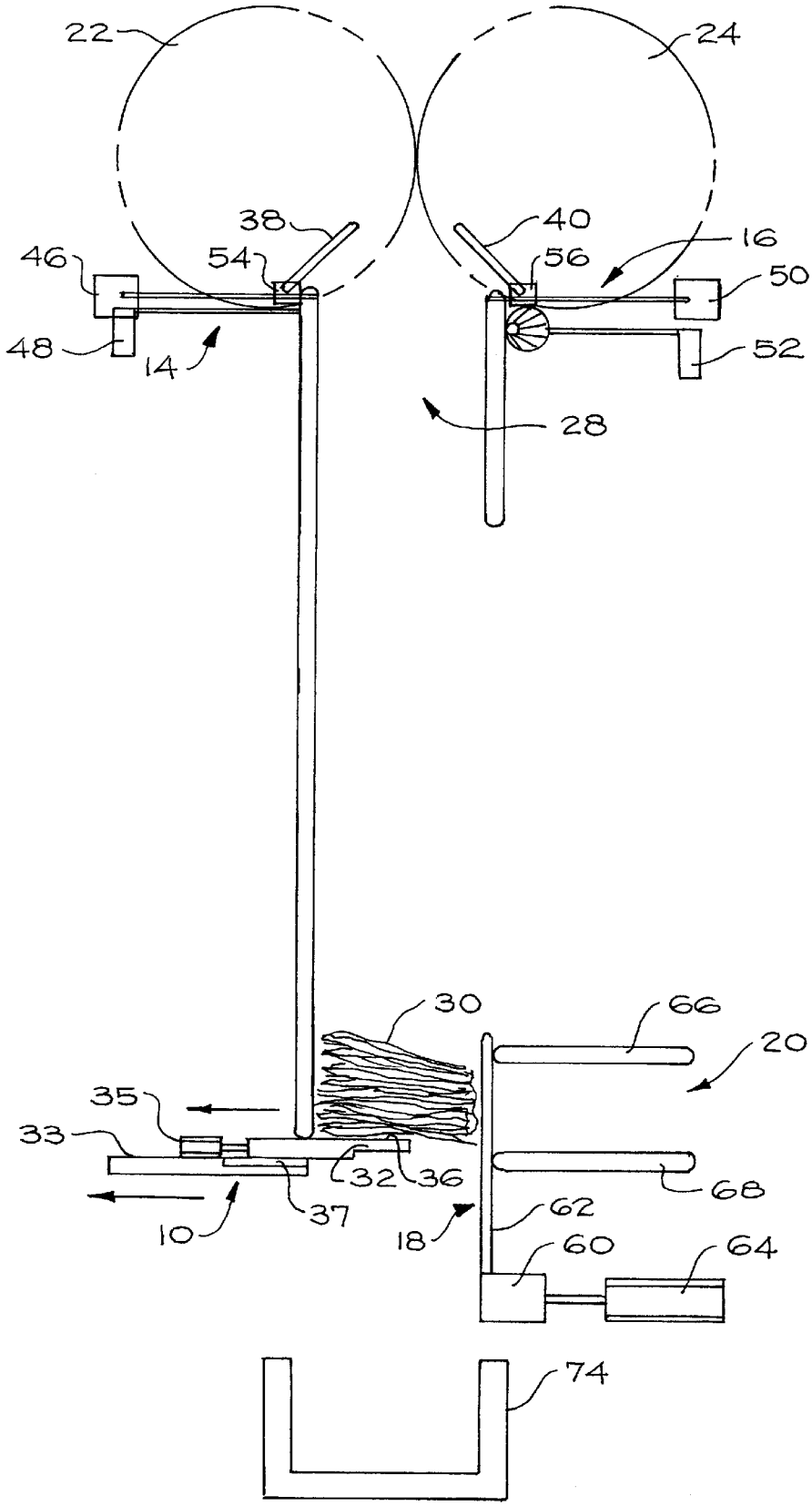

Once a misfeed or jam is detected (whether by an operator, conventional sensor or sensors, etc.), the controller preferably sends signals to lower the stack building carriage 10 down along the track assembly 12 and to move the load finger assembly 18 via the load finger assembly actuator 64 to a position from beneath the stack building area 28 as shown in FIG. 14. Preferably, upon reaching the lower limit of the track assembly 12, the stack building carriage 10 is actuated by the actuator 35 to retract the floor 32 of the stack building carriage 10 from its position in the stack building area 28. As described above, the actuator 35 (preferably mounted to the mounting portion 33 of the stack building carriage 10) moves the floor 32 by pulling or pushing the floor out of the stack building area 28. This movement is shown in FIG. 15, and causes the stack 30 on top of the stack building carriage 10 to drop to the reject conveyor 74 which carries away the stack 30. It should be noted that the mounting portion 33 and the floor 32 can be connected for retraction of the floor 32 in a large number of ways well known to those skilled in the art, some employing the rail, track or guide mounting arrangement described above in the preferred embodiment of the present invention, and some not. Extension and retraction can, for example, be performed by sliding the floor 32 in a desired direction out of the stack building area 28, pivoting the floor 32 to the mounting portion 33 to selectively pivot the floor 32 away from the stack building area 28, and the like. Such movement can be accomplished by a number of elements and systems well-known to those skilled in the art, including without limitation conventional actuators, gear and rack systems, direct rotation by a motor, and even magnetic rail systems.

Figure 16:
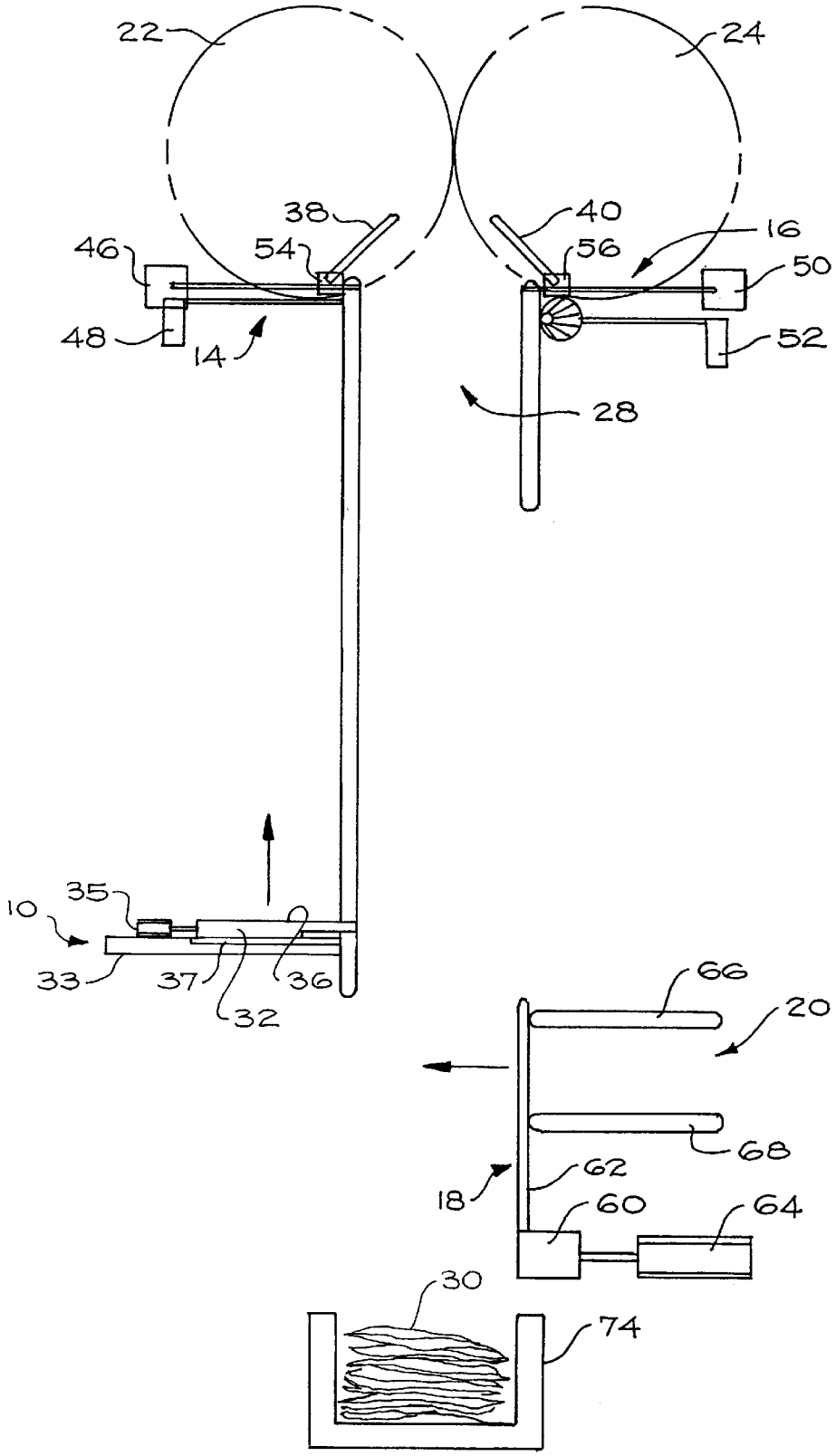

After the misfed stack 30 has been dropped to the reject conveyor 74, the controller preferably sends signals to raise the stack building carriage 10 on the track assembly 12 and to return the load finger assembly 18 via the load finger assembly actuator 64 to its retracted position as shown in FIG. 16. Simultaneous with this motion or shortly thereafter, the controller also sends a signal to the stack building carriage actuator 35 to extend the floor 32 back into the stack building area 28 in preparation for the next stack building and stack separating operations. As can be seen in FIG. 16, the movement of the stack building carriage 10 and the load finger assembly 18 out from their positions in line with the stack building area 28 creates a largely unobstructed path for debris, jammed paper, and misfed product to fall to the reject conveyor 74 below. This stack building area cleaning feature of the present invention can be initiated at virtually any time during system operation, and greatly shortens system downtime caused by misfeeds and jams.

The embodiments described above and illustrated in the drawings are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

For example, the load fingers 62 and the floor 32 of the stack building carriage 10 are described above as being able to intermesh without interference by virtue of their comb shapes. The fingers 36 of the stack building carriage floor 32 fit between the load fingers 62 of the load finger assembly 18. Therefore, the two elements permit unhindered movement of the load finger assembly 18 with respect to the stack building carriage 10 during the steps of stack discharge. Once again, the freedom provided by this movement permits the stack building carriage 10 to quickly return to its upper positions without waiting for any system elements to retract or otherwise move out of the way. It will be appreciated by one having ordinary skill in the art that a number of other elements and arrangements can be made which achieve the same function as the load finger assembly 18 and the stack building carriage 10. For example, the actuator 64 can be arranged to push one or more bars which fit between the fingers 36 of the stack building carriage 10 but which have a sufficient "footprint" upon the completed stack 30 to push the same from the stack building carriage 10. Alternately, a bar, series of fingers, or other element(s) (oriented, for example, perpendicular to the plane of the page in FIGS. 2–16) can sweep across the top of the stack building carriage 10 after the stack building carriage 10 reaches its stack discharge position, and remain beside or between the conveyor belts 66, 68 until the stack building carriage 10 returns to its above positions. In these cases, the stack building carriage 10 has virtually no interference with the element or assembly pushing the completed stack 30 off of the stack building carriage 10, and is free to return to its above positions without the delay of first waiting for other elements to move. In still more advanced systems, all or part of the floor 32 of the stack building carriage 10 can be a conventional endless conveyor belt having a stacksupporting horizontal surface. The endless conveyor belt can be driven in any conventional fashion (e.g., via one or more sprockets driven by chains or belts to a motor beneath or beside the stack building floor 32, etc.) to discharge the completed product stack 30 to the conveyor belts 66, 68 when the stack building carriage 10 reaches its stack discharging position. Such a system eliminates the need for a load finger assembly 18 driven by an actuator 64.

As another example of the various changes in the elements and their configuration and arrangement which would be appreciated by one having ordinary skill in the art, it should be noted that the fold over fingers employed in the preferred embodiment of the present invention are only one type of device which can be used to initiate or create the final fold in the product stack. For example, rather than have one set of fold over fingers one side of the product stack and a set of fluid emitters on an opposite side, two fold over finger sets can be used to produce the final fold. Similar to the fold over fingers of the Retzloff patent mentioned above (U.S. Pat. No. 4,874,158), opposing fold over fingers can be actuated to extend one above the other in the dangling product tail to create the desired final fold. Such an alternate arrangement finds particular applicability for those products which are heavier or which do not respond well to a burst of air from the air jets of the highly preferred embodiment. However, the fluid emitters of some preferred embodiments are known to be the most effective and fastest in their final folding operation for very light and/or delicate web products such as tissue paper and thin foils. If heavier or thicker product is to be stacked and separated, and emitters are still desired in the final fold operation, other types of emitters (emitting any sort of fluid, such as waterjets) can be used, dependent at least partly upon the web material being processed. Where the fold over operation is desired on a system, such alternative fold over designs fall within the spirit and scope of the present invention.

Additionally, it will be appreciated by one having ordinary skill in the art that a number of count and separation finger types can be used in the present invention. These alternative count and separation finger designs are well-known and also fall within the spirit and scope of the present invention. Because in the preferred embodiment of the present invention the separation and count fingers are located adjacent each other in each stage of the stacking and separating process, it is even possible to substitute both the separation and count fingers with one finger which is capable (via speed and/or manner of insertion) of being inserted into the product stream and which performs the same functions as both the count and separation fingers. Of course, though not preferred, even more fingers can be employed in the present invention to perform dedicated functions (e.g., a separate set of horizontally-disposed fingers upon which the new product stack temporarily rests after final fold operations until the stack building carriage is elevated nearby).

Also, while the various elements and assemblies of the present invention are described as being controlled by a conventional controller, one having ordinary skill in the art will appreciate that many prior art control mechanisms and systems can instead be used with equal effectiveness to move and operate the elements and assemblies. Possible control mechanisms include computer or microprocessor controllers, solid state systems, and even manual controls operable directly by a user, any of which can be supplemented with various conventional sensors for detecting when element and assembly movements have been completed or are being performed.

Finally, although the apparatus of the present invention is described and illustrated herein as being oriented vertically, it will be appreciated by one having ordinary skill in the art that the advantages of the invention can be realized for apparatuses which are oriented in other ways, such as horizontally, diagonally, etc. As such, the literal function of the various elements and assemblies of the present invention can be changed to a significant extent without departing from the spirit and scope of the present invention. For example, if the present apparatus were horizontally oriented, the stack building carriage 10 would not necessarily support the product stacks 30, 58 so much as it would contain the product stacks 30, 58 with the assistance of the front separation fingers 46.

I claim:

1. A separator apparatus for separating a first stack of product from a second stack of product, the separator apparatus comprising: a frame;

a controller;

a package building carriage movably coupled to the frame and having a surface capable of at least partially supporting the first stack of product, the surface being disposed in a plane defined by a portion of the package building carriage, the package building carriage movable upward and downward by the controller through a first path of motion between a package building position and a package discharging position;

an actuator coupled to the controller for actuation by the controller;

at least one load finger coupled to the actuator and movably coupled to the frame for reciprocating motion between first and second positions, the first position associated with a location out of interference with said first path and said second position intersecting with said first path, the at least one load finger laterally movable by the actuator relative to the package building carnage in a second path of motion passing through the plane of the carriage surface in at least a portion of the first path of motion as said at least one load finger moves between said first and second positions, the package building carriage movable upward and downward and the at least one load finger simultaneously laterally movable through carriage plane substantially free from interference with the carriage such that as said carriage moves upwardly away from the package discharge station said at least one load finger is substantially simultaneously caused by said controller to move from said second position to said first position.

2. The separator apparatus as claimed in claim 1, wherein the surface of the package building carriage is at least partly defined by at least two fingers for stacking product thereupon.

3. The separator apparatus as claimed in claim 1, wherein the apparatus has at least two load fingers for pushing a stack of product from the package building carriage.

4. The separator apparatus as claimed in claim 2, wherein the surface of the package building carriage is at least partly defined by at least two fingers for stacking product thereupon.

5. The separator apparatus as claimed in claim 4, wherein:

the load fingers are spaced apart sufficiently to receive the fingers of the carriage therebetween; and the load fingers and the fingers of the carriage are movable with respect to one another with substantially no interference.

6. The separator apparatus as claimed in claim 1, further comprising a reject conveyor for receiving stacks of product rejected from the separator apparatus.

7. The separator apparatus as claimed in claim 6, further comprising a stack building area in the first path of motion, wherein the reject conveyor is located beneath the stack building area for receiving rejected stacks from the stack building area.

8. The separator apparatus as claimed in claim 1, further comprising a finger assembly located adjacent the first path of motion and disposed for movement alongside at least a part of the first path of motion, the finger assembly having at least one actuator and at least one finger coupled to the at least one actuator and movable thereby toward and away from the first path of motion.

9. The separator apparatus as claimed in claim 1, further comprising a pair of finger assemblies disposed for movement alongside at least a part of the first path of motion, each finger assembly having at least one actuator and at least one finger coupled to the at least one actuator and movable thereby toward and away from the first path of motion.

10. The separator apparatus as claimed in claim 8, wherein the finger assembly has at least one count finger mounted for pivotal rotation upon the finger assembly, the at least one count finger pivotable between a first position in contact with a stack of product and a second position away from the stack of product.

11. The separator apparatus as claimed in claim 10, wherein the at least one count finger is translatable toward and away from the stack of product.

12. The separator apparatus as claimed in claim 8, further comprising:

a stack building area through which product stacks upon the stack building carriage pass; and at least one separation finger movable into and out of the stack building area between the first stack of product and the second stack of product for separating the first stack of product from the second stack of product.

13. The separator apparatus as claimed in claim 12, wherein the at least one separation finger is attached to the finger assembly for motion therewith, the at least one separation finger movable into and out of the stack building area along at least a part of the first path of motion.

14. The separator apparatus as claimed in claim 13, wherein the separation finger is movable horizontally into the stack building area between the first stack of product and the second stack of product.

15. The separator apparatus as claimed in claim 1, further comprising:

a stack building area through which product stacks upon the stack building carriage pass; and a first fold over finger movable substantially horizontally into and out of the stack building area beneath the second stack of product to push a tail of the second stack of product for initiating a final fold in the second stack of product.

16. The separator apparatus as claimed in claim 15, further comprising a second fold over finger located on an opposite side of the stack building area and movable horizontally into and out of the stack building area to push the tail of the second stack of product, the first fold over finger and the second fold over finger spaced vertically proximate one another for initiating a fold in the second stack of product.

17. The separator apparatus as claimed in claim 15, further comprising at least one fluid emitter directed toward the tail of the second stack of product and adapted for emitting a jet of fluid against the tail to fold the tail over the first fold over finger.

18. A separator apparatus for separating product stacks, the separator apparatus comprising:

a controller;

a stack building carriage movable upwardly and downwardly under control by the controller through a range of positions defining a first path, the stack building carriage having a floor at least partially defining a plane;

a first actuator coupled to the controller; and means coupled to the actuator for discharging a product stack from the stack building carriage, the means being laterally movable with respect to the stack building carriage through the plane of the stack building carriage floor, wherein the means for discharging the product stack from the stack building carriage is reciprocally laterally movable between a first position associated with a location out of interference with said first path and a second position intersecting with said first path such that when the discharging means moves to the second position it moves through the plane of the stack building carriage floor; and wherein when said carriage moves upwardly from a discharge station, said controller causes said discharging means to move from said second position to said first position substantially simultaneously with the upward movement of said stack building carriage without obstruction by the stack building carriage.

19. The separator apparatus as claimed in claim 18, wherein:

the stack building carriage has a surface defined by at least two fingers upon which a product stack can rest; and the means for discharging a product stack has a surface defined by at least one load finger movable through the fingers of the stack building carriage.

20. The separator apparatus as claimed in claim 18, further comprising a reject conveyor positioned to receive rejected product stacks from the separator apparatus.

21. The separator apparatus as claimed in claim 20, wherein the stack building carriage is laterally movable from the first path sufficiently to permit a product stack thereon to drop to the reject conveyor.

22. The separator apparatus as claimed in claim 18, further comprising a finger assembly located beside the first path, the finger assembly having at least one separation finger translatable into and away from the first path.

23. The separator apparatus as claimed in claim 22, wherein the finger assembly is mounted for movement beside at least a part of the first path to permit the at least one separation finger to be inserted in a range of positions along the first path.

24. The separator apparatus as claimed in claim 18, further comprising a finger assembly located beside the first path, the finger assembly having at least one fold over finger movable toward and away from the first path.

25. The separator apparatus as claimed in claim 24, wherein the finger assembly is mounted for movement beside at least a part of the first path to permit the at least one fold over finger to be inserted in a range of positions along the first path.

26. The separator apparatus as claimed in claim 25, further comprising a second fold over finger located on an opposite side of the first path, the second fold over finger being translatable toward and away from the at least one fold over finger for initiating a final fold in a product stack.

27. The separator apparatus as claimed in claim 25, further comprising a fluid emitter located on an opposite side of the first path, the fluid emitter adapted to emit a jet of fluid toward the at least one fold over finger to initiate a final fold in a product stack tail therebetween.

28. A separator apparatus for separating a first stack of product from a second stack of product, the separator apparatus comprising:

a package building carriage for supporting the first stack of product, the package building carriage movable through a first path of motion between a package building position and a package discharging position;

at least one load finger and associated actuator having a second path of motion passing through the package discharging position and the package building carriage when the package building carriage is in the package discharging position;

a controller controllably connected to each of the building carriage and the at least one load finger actuator and the at least one load finger reciprocally laterally movable between a first position associated with a location out of interference with said first path and a second position intersecting with said first path such that when the at least one load finger moves to the second position it moves through a plane of the building carriage, and wherein when said carriage moves upwardly from the discharging position said controller causes said at least one load finger to move from said second position to said first position substantially simultaneously with the upward movement of said carriage without obstruction by the stack building carriage;

a stack building area through which product stacks upon the stack building carriage pass;

a finger assembly located adjacent to the first path of motion and disposed for movement alongside at least a part of the first path of motion; and at least one separation finger attached to the finger assembly for motion therewith, the at least one separation finger horizontally insertable into and out of.

29. A separator apparatus for separating product stacks, the separator apparatus comprising:

a controller;

a stack building carriage movable through a range of positions defining a first path under control by the controller, the stack building carriage having a floor at least partially defining a plane;

a first actuator coupled to the controller;

a load finger assembly coupled to the actuator and reciprocally movable between a first position located out of interference with said first path and a second position intersecting with said first path to define a second path of travel of said load finger intersecting the first path in which at least a portion of the load finger assembly passes through the plane defined by the floor of the stack building carriage, the load finger assembly free to move substantially through its range of positions in the second path without obstruction by the stack building carriage through its range of positions in the first path;

a reject conveyor positioned to receive rejected product stacks from the separator apparatus, wherein the stack building carriage is laterally movable from the first path sufficiently to permit a product stack thereon to drop to the reject conveyor;

the stack building carriage and load finger assembly movable substantially simultaneously by the controller in at least part of the first path of the stack building carriage such that as said carriage moves upwardly from a discharge station said load finger is substantially simultaneously caused to move from said second position to said first position.

* * * * *